US007543918B2

(12) United States Patent
Katayama et al.

(10) Patent No.: US 7,543,918 B2
(45) Date of Patent: Jun. 9, 2009

(54) LIQUID JETTING HEAD AND METHOD FOR PRODUCING THE SAME

(75) Inventors: Naoki Katayama, Kariya (JP); Hiroto Sugahara, Aichi-ken (JP); Yoshikazu Takahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 469 days.

(21) Appl. No.: 11/513,402

(22) Filed: Aug. 31, 2006

(65) Prior Publication Data

US 2007/0046736 A1 Mar. 1, 2007

(30) Foreign Application Priority Data

Aug. 31, 2005 (JP) ..... 2005-250795

(51) Int. Cl.
*B41J 2/045* (2006.01)

(52) U.S. Cl. ..... 347/68

(58) Field of Classification Search ..... 347/68, 347/69–72, 64; 400/124.16; 310/311; 29/25.35, 29/890.1

See application file for complete search history.

(56) References Cited

U.S. PATENT DOCUMENTS 6,808,254 B2 * 10/2004 Sakaida et al. ..... 347/71
6,971,738 B2 12/2005 Sugahara
6,973,703 B2 * 12/2005 Sakaida et al. ..... 29/25.35
6,994,428 B2 * 2/2006 Ito ..... 347/71
7,387,372 B2 * 6/2008 Ishikawa et al. ..... 347/68
2003/0107622 A1 6/2003 Sugahara
2004/0218018 A1 11/2004 Sakaida et al.
2005/0185028 A1 8/2005 Sakaida et al.

FOREIGN PATENT DOCUMENTS

JP H01-204748 A 8/1989
JP 2004160966 A 6/2004
JP 2004166463 A 6/2004
JP 2004209874 A 7/2004

* cited by examiner

*Primary Examiner*—K. Feggins
(74) *Attorney, Agent, or Firm*—Baker Botts L.L.P.

(57) ABSTRACT

An ink-jet head includes a channel unit in which a plurality of pressure chambers are formed; and a piezoelectric actuator which includes a vibration plate, a piezoelectric layer formed on an upper surface of the vibration plate, and an electroconductive layer formed on an upper surface of the piezoelectric layer. On an upper surface of the piezoelectric actuator, there are formed outer grooves each extended along an area overlapping with the periphery of each of the pressure chambers, and inner grooves each extended along one of the outer grooves at a portion inside of one of the outer grooves. Further, recesses deeper than the thickness of the electroconductive layer is formed in the piezoelectric actuator at portions each located inside of the one of the inner grooves. Accordingly, it is possible to improve a drive efficiency of the piezoelectric actuator.

25 Claims, 16 Drawing Sheets

LIQUID JETTING HEAD AND METHOD FOR PRODUCING THE SAME

CROSS-REFERENCE TO RELATED APPLICATION

The present application claims priority from Japanese Patent Application No. 2005-250795, filed on Aug. 31, 2005, the disclosure of which is incorporated herein by reference in its entirety.

BACKGROUND OF THE INVENTION

1. Field of the Invention

The present invention relates to a liquid jetting head which jets or discharges a liquid from a nozzle, and a method of producing the liquid jetting head.

2. Description of the Related Art

As an ink-jet head which jets an ink onto a recording medium, ink-jet heads having various structures have been proposed or brought into practical use. Among these ink-jet heads, an ink-jet head described in U.S. Pat. No. 6,971,738 includes a channel unit in which a plurality of pressure chambers communicating with nozzles respectively is formed, and a piezoelectric actuator which applies pressure to an ink in the pressure chambers, by changing a volume of the pressure chambers.

The piezoelectric actuator of this ink-jet head includes a plurality of piezoelectric sheets made of lead zirconate titanate (PZT) and arranged to cover the pressure chambers, and individual electrodes (drive electrodes) and common electrodes which are arranged alternately between these piezoelectric sheets. The individual electrodes and the common electrodes are formed at an area inside of each of the pressure chambers, along a periphery of each of the pressure chambers, as viewed from a direction orthogonal to a plane of the piezoelectric sheets so as to be ring-shaped.

Moreover, this piezoelectric actuator is capable of easily performing a so-called pulling ejection in which, after an ink in the pressure chambers is drawn in by once increasing a volume of the pressure chambers, a substantial pressure is applied to the ink in the pressure chambers by decreasing the volume of the pressure chambers. In other words, when a driving signal (positive electric potential) is supplied to the individual electrodes while the common electrodes are kept at a ground electric potential, ring-shaped portions of the piezoelectric sheets overlapping with the edge of each of the pressure chambers, which are sandwiched between the individual electrodes and the common electrodes, are contracted in a direction parallel to the plane of the piezoelectric sheets. As a result, the piezoelectric sheets are deformed to project toward a side opposite to the pressure chambers, and the volume inside the pressure chambers is increased, thereby generating a negative pressure wave in the pressure chambers. Furthermore, when the supply of the driving signal to the individual electrodes is stopped at a timing at which the pressure wave is changed to a positive pressure wave in the pressure chambers, the piezoelectric sheets are returned to the original shape to decrease the volume inside the pressure chambers. At this time, the pressure wave generated with the increase in the volume of the pressure chambers and the pressure wave generated upon restoration of the shape in the piezoelectric sheets are combined, thereby applying a substantial pressure to the ink. Therefore, this piezoelectric actuator is capable of efficiently applying the pressure to the ink at a relatively low drive voltage. Moreover, only at a timing of jetting the ink, the driving signal is supplied to the individual electrodes to make an electric field to act in the piezoelectric layers. Therefore, the electric field is not applied in the piezoelectric layers at a timing other than the timing of the ink discharge, and polarization degradation hardly occurs in the piezoelectric layers, thereby enhancing or improving durability of the piezoelectric actuator.

SUMMARY OF THE INVENTION

However, when stiffness is high in the piezoelectric actuator at areas thereof overlapping with the pressure chambers, (particularly areas each of which overlaps with a central portion of one of the pressure chambers, and each of which no individual electrode is formed), a driving signal of an electric potential higher than an electric potential of the individual electrode is consequently applied so as to apply a predetermined pressure to the ink in the pressure chamber, thereby increasing an electric power consumption of the piezoelectric actuator. Therefor, for the purpose of improving drive efficiency of the piezoelectric actuator, a structure is demanded which is capable of increasing an amount of deformation of the piezoelectric actuator without increasing the drive voltage. Moreover, it is desirable that the structure is applicable not only to a piezoelectric actuator having multilayered piezoelectric layers but also to a single-layered piezoelectric actuator.

Therefore, an object of the present invention is to provide a liquid jetting head with excellent drive efficiency of a piezoelectric actuator, and a method of producing the liquid jetting head.

According to a first aspect of the present invention, there is provided a liquid jetting head which jets a liquid, including:

a channel unit in which a plurality of pressure chambers separated mutually by partition walls, a plurality of nozzles, and a plurality of individual liquid channels each reaching one of the nozzles via one of the pressure chambers are formed; and a piezoelectric actuator which applies a jetting energy to the liquid in the pressure chambers and which includes a plate which is fixed to the partition walls to define the pressure chambers, and which has an electroconductive surface on a side opposite to the pressure chambers; a piezoelectric layer which is formed on the plate at an area on a surface of the plate on the side opposite to the pressure chambers; an electroconductive layer which is formed on the piezoelectric layer at an area on a surface of the piezoelectric layer on a side opposite to the plate; the area on the surface of the plate and the area on the surface of the piezoelectric layer facing all the pressure chambers; and a plurality of individual electrodes each of which is insulated from the electroconductive layer by a first groove formed in the electroconductive layer, along an outer periphery of one of the pressure chambers, and by a recess formed on a central area of one of the pressure chambers with respect to the first groove, wherein: a depth of the first groove is not less than a thickness of the electroconductive layer, and a depth of the recess is greater than the thickness of the electroconductive layer.

The first groove, as described above, includes not only a groove overlapping exactly with the outer periphery of each of the pressure chambers but overlapping also with a portion in the vicinity of the outer periphery of each of the pressure chambers. In other words, the first groove also includes a groove which is extended along the outer periphery of each of the pressure chambers, at an area in the vicinity of the outside of the pressure chamber as well as at an area in the vicinity of the inside of the pressure chamber. Further, by the first groove and the recess, each of the individual electrodes is formed in the piezoelectric layer at an area facing the periphery of one of the pressure chambers. Here, the term "periphery" is not limited to a periphery completely circulating the outer periphery of the pressure chamber but also includes a periphery which is partially interrupted in the periphery and a periphery which is partially away from the outer periphery of the pressure chamber. In this structure, when a driving signal (drive voltage) is supplied to a certain individual electrode, a portion of the piezoelectric layer, for example, a portion between the individual electrode and the plate such as a vibration plate is contracted in a direction of a plane of the piezoelectric layer. Then, the vibration plate is deformed to project toward a side opposite to the pressure chamber, with a portion facing the center of the pressure chamber as an apex of the deformation. As a result, a volume of the pressure chamber is increased to generate a negative pressure wave in the pressure chamber. Further, when the supply of the driving signal to the individual electrode is stopped at a timing when the pressure wave is changed to a positive pressure wave in the pressure chamber, the vibration plate returns to its original shape, thereby changing the volume of the pressure chamber to its original volume. At this time, however, the pressure wave generated by the increase in the volume of the pressure chamber and a pressure wave generated upon restoration of the shape of the vibration plate are combined, thereby applying a substantial pressure to the liquid in the pressure chamber. Consequently, it is possible to apply a high pressure to the liquid at a relatively low drive voltage, thereby improving drive efficiency of the piezoelectric actuator. Moreover, since it is enough that an electric field is applied to the piezoelectric layer only at a timing of transporting the liquid, the polarization degradation hardly occurs in the piezoelectric layer, and the piezoelectric layer becomes highly durable. Furthermore, since the recess reaching up to the piezoelectric layer is formed in an area disposed inside the first groove (inside of the first groove), a thickness of the piezoelectric actuator is partially reduced at a predetermined area thereof, and stiffness of the thin portion is reduced or lowered to be less than stiffness of the other area. Therefore, when the driving signal is supplied to the individual electrode, the vibration plate and the piezoelectric layer which are facing the pressure chambers are easily deformed, thereby substantially increasing the volume of the pressure chambers. Consequently, the drive efficiency of the piezoelectric actuator is improved. Moreover, the deformation of the vibration plate and the piezoelectric layer which are facing a certain pressure chamber is hardly propagated to a portion corresponding to another pressure chamber adjacent to the certain pressure chamber, thereby making it possible to reduce the cross-talk.

In the liquid jetting head of the present invention, the recess may include a second groove which is formed along a direction in which the first groove is extended; and a first recess which is formed in the piezoelectric actuator at a predetermined area, on a central area of each of the pressure chambers with respect to the second groove; and a depth of the second groove may be not less than the thickness of the electroconductive layer, and a depth of the first recess may be greater than the thickness of the electroconductive layer. In this case, since the first recess reaching up to the piezoelectric layer is formed in the predetermined area, the thickness of the piezoelectric actuator at the predetermined area is reduced partially, and the stiffness of the predetermined area is reduced to be less than the stiffness of the other area. Moreover, since the depth of the second groove is not less than the thickness of the electroconductive layer, it is possible to assuredly insulate the individual electrodes from the electroconductive layer surrounding the electrodes.

In the liquid jetting head of the present invention, the first recess may be formed in the piezoelectric layer. Accordingly, since the stiffness of the piezoelectric layer in the predetermined area is decreased, it is possible to substantially deform an area, of the piezoelectric actuator, facing the pressure chamber.

In the liquid jetting head of the present invention, a recess may be formed in the plate at an area overlapping with the first recess. Accordingly, since the stiffness of the plate such as the vibration plate is decreased in the predetermined area thereof, it is possible to substantially deform the area, of the piezoelectric actuator, facing the pressure chamber.

In the liquid jetting head of the present invention, the pressure chambers may be long in one direction, and the first recess may be extended in the one direction. Accordingly, although when the pressure chamber is extended in the one direction, it is possible to substantially deform the piezoelectric actuator corresponding to the pressure chambers.

In the liquid jetting head of the present invention, the predetermined area may face a central portion of each of the pressure chambers. Accordingly, since the stiffness of the piezoelectric actuator at an area thereof corresponding to the central portion of each of the pressure chambers is decreased, it is possible to substantially deform the area, of the piezoelectric actuator, facing the pressure chambers.

In the liquid jetting head of the present invention, a second recess which opens toward each of the pressure chambers may be formed in a surface of the plate on a side of the pressure chambers. Accordingly, since the second recess is formed in the area of the plate such as the vibration plate, the area facing the pressure chambers, the stiffness of this area of the plate is decreased than stiffness of the other area of the plate. Therefore, it is possible to substantially deform the area of the piezoelectric actuator facing the pressure chambers.

In the liquid jetting head of the present invention, the pressure chambers may be long in one direction, and the second recess may be extended in the one direction, in the plate at an area facing a central portion of each of the pressure chambers. Accordingly, although when the pressure chambers are extended in the one direction, it is possible to substantially deform the piezoelectric actuator in accordance with the pressure chambers.

In the liquid jetting head of the present invention, the second recess may be extended in a ring-shape along a periphery of each of the pressure chambers. Accordingly, since the stiffness of an area, of the plate such as the vibration plate, facing the periphery of each of the pressure chambers is decreased to be less than the stiffness of the other area, it is possible to substantially deform the area, of the piezoelectric actuator, facing each of the pressure chambers. Moreover, when the driving signal is supplied to the individual electrodes, a partial deformation of the piezoelectric actuator at the area facing the pressure chamber is hardly propagated to a portion, of the piezoelectric actuator, facing a pressure chamber adjacent to the pressure chamber. Therefore, it is possible to suppress the cross-talk.

In the liquid jetting head of the present invention, the first groove may be formed in the piezoelectric layer. In this case, since the first groove is reached up to the piezoelectric layer, the stiffness of the piezoelectric layer is decreased. Therefore, it is possible to substantially deform the area, of the piezoelectric actuator, facing each of the pressure chambers. Moreover, the deformation of the piezoelectric actuator at a portion facing a pressure chamber when the driving signal is supplied to the individual electrode is hardly propagated to another portion of the piezoelectric actuator facing another pressure chamber adjacent to the pressure chamber. Therefore, it is possible to suppress further the cross-talk. It is enough that at least a part of the piezoelectric layer.

In the liquid jetting head of the present invention, the second groove may be formed in the piezoelectric layer. Accordingly, since the second groove is reached up to the piezoelectric layer, the stiffness of the piezoelectric layer is decreased. Therefore, it is possible to substantially deform the area of the piezoelectric actuator, facing each of the pressure chambers. It is enough that at least a part of the piezoelectric actuator is removed.

In the liquid jetting head of the present invention, each of the first groove and the second groove may be extended in a circular shape; and each of the individual electrodes may be formed to be doughnut-shaped. Accordingly, in a ring-shaped area, of the piezoelectric actuator, facing a peripheral area of each of the pressure chambers, the deformation of the piezoelectric layer and the plate such as the vibration plate becomes substantial.

In the liquid jetting head of the present invention, the pressure chamber may be long in one directions and the first groove and the second groove may be extended in the one direction, and each of the individual electrodes may have two areas which sandwich the central portion of one of the pressure chambers, and which are extended in parallel mutually along the one direction. Accordingly, in areas of the piezoelectric actuator, each facing the periphery along the one direction of one of the pressure chambers, the deformation of the piezoelectric layer and the plate such as the vibration plate becomes substantial.

According to a second aspect of the present invention, there is provided a liquid jetting head which jets a liquid, including:

a channel unit in which a plurality of pressure chambers separated mutually by partition walls, a plurality of nozzles, and a plurality of individual liquid channels each reaching up to one of the nozzles via one of the pressure chambers are formed, and a piezoelectric actuator which applies a jetting energy to the liquid in the pressure chambers and which includes: a plate which are fixed to the partition walls to define the pressure chambers, and which has an electroconductive surface on a side opposite to the pressure chambers; a piezoelectric layer which is formed on the plate at an area on a surface of the plate on the side opposite to the pressure chambers; an electroconductive layer on the piezoelectric layer at an area on a surface of the piezoelectric layer on a side opposite to the plate; the area on the surface of the plate and the area on the surface of the piezoelectric layer facing all the pressure chambers; and a plurality of individual electrodes each of which is insulated from a surrounding thereof, by a first groove formed along an outer periphery of one of the pressure chambers, and by a recess formed on a central area of one of the pressure chambers with respect to the first groove, wherein a depth of the first groove is greater than the thickness of the electroconductive layer, and a depth of the recess is not less than the thickness of the electroconductive layer.

According to the second aspect of the present invention, the depth of the first groove reaches up to the piezoelectric layer, and further the recess is formed inside the first groove. Accordingly, when a driving signal is supplied to the individual electrode, the plates such as the vibration plate and the piezoelectric layer which are facing the pressure chamber are easily deformed, thereby substantially increasing a volume of the pressure chamber. Consequently, drive efficiency of the piezoelectric actuator is improved. In addition, the deformation of the plate and the piezoelectric layer facing a pressure chamber is hardly propagated to a portion facing a pressure chamber adjacent to the pressure chamber. Therefore, the cross-talk can be reduced.

According to a third aspect of the present invention, there is provided a method of producing a liquid jetting head including a channel unit in which a plurality of individual liquid channels reaching up to nozzles via pressure chambers respectively is formed, and in which mutually adjacent pressure chambers among the pressure chambers are separated by partition walls; and a piezoelectric actuator which applies a jetting energy to the liquid in the pressure chambers, the method including:

a step for providing the channel unit in which the pressure chambers are formed;

a step for providing a substrate;

a plate-forming step for forming a plate which defines the pressure chambers when the substrate is fixed to the partition walls of the channel unit, by forming an electroconductive layer on a surface of the substrate on a side to be arranged opposite to the pressure chambers;

a piezoelectric-layer forming step for forming a piezoelectric layer, without a gap, in an area on an electroconductive surface of the plate, the area facing all the pressure chambers when the plate is fixed to the channel unit;

an electroconductive-layer forming step for forming an electroconductive layer, without a gap, in an area on a surface of the piezoelectric layer on a side opposite to the plate, the area facing all the pressure chambers when the plate is fixed to the channel unit;

an individual-electrode forming step for forming individual electrodes insulated from the electroconductive layer surrounding the individual electrodes, by removing the electroconductive layer along the outer periphery of each of the pressure chambers to form a first groove having a depth of not less than the thickness of the electroconductive layer, and by removing the electroconductive layer along a direction in which the first groove is extended to form a second groove having a depth of not less than the thickness of the electroconductive layer on a central area of each of the pressure chambers with respect to the first groove, and a first-recess forming step for forming a first recess having a depth of more than the thickness of the electroconductive layer by removing the electroconductive layer and the piezoelectric layer at the central area of each of the pressure chambers with respect to the second groove.

The first groove, which is formed in the individual-electrode forming step, includes not only a groove overlapping exactly with the outer periphery of one of the pressure chambers but also overlapping with a portion in the vicinity of the outer periphery of each of the pressure chambers. Accordingly, when the driving signal is supplied to an individual electrode, portion of the piezoelectric layer between the plate, such as a vibration plate, and the individual electrode is contracted in a direction of a plane of the piezoelectric layer. As the portion of the piezoelectric layer is contracted, the plate is deformed to project toward a side opposite to the pressure chamber, with a portion facing the center of the pressure chamber as an apex of the deformation. As a result, a volume of the pressure chamber is increased, and a negative pressure wave is generated in the pressure chamber. Furthermore, when the supply of the driving signal to the individual electrode is stopped at a timing when the pressure wave in the pressure chamber is changed to a positive pressure wave, the plate restores to its original shape, and the volume of the pressure chamber is changed to its original volume. At this time, however, a pressure wave generated due to an increase in the volume of the pressure chamber and a pressure wave generated due to restoring the original shape of the vibration plate are combined, thereby applying a substantial pressure to the liquid in the pressure chamber. Consequently, it is possible to apply a high pressure to the liquid at a relatively low drive voltage. It is thus possible to produce a liquid jetting head in which the drive efficiency of the piezoelectric actuator is improved. Moreover, it is enough that an electric field is applied to the piezoelectric layer only at a timing of transporting the liquid, the polarization degradation hardly occurs in the piezoelectric layer, and the piezoelectric layer becomes highly durable. Furthermore, since the first recess reaching up to the piezoelectric layer is formed in the piezoelectric actuator at a predetermined area thereof in the first-recess forming step, a thickness of the predetermined area of the piezoelectric actuator is partially reduced, and stiffness of this thin portion is lowered to be less than stiffness of the other area. Therefore, when the driving signal is supplied to an individual electrode, the plate and the piezoelectric layer which are facing the pressure chamber are easily deformed, thereby increasing the volume of the pressure chamber. Consequently, the drive efficiency of the piezoelectric actuator is improved. In addition, the deformation of the plate and the piezoelectric layer which are facing a pressure chamber is hardly propagated to a portion corresponding to another pressure chamber adjacent to this pressure chamber, thereby reducing the cross-talk.

In the method of producing the liquid jetting head of the present invention, in the first-recess forming step, the first recess may be formed by removing the piezoelectric layer at a portion on a central area of each of the pressure chambers with respect to the second groove. Accordingly, since the stiffness of the piezoelectric layer in the predetermined area is decreased, it is possible to substantially deform an area of the piezoelectric actuator facing the pressure chamber.

In the method of producing the liquid jetting head of the present invention, in the first-recess forming step, the first recess may be formed by removing a part of the plate on the central area of each of the pressure chambers with respect to the second groove. Accordingly, since stiffness of the plate in the area on the central area of each of the pressure chambers with respect to the second groove is decreased, it is possible to substantially deform the area of the piezoelectric actuator facing the pressure chamber.

In the method of producing the liquid jetting head, in the individual-electrode forming step, the first groove may be formed by removing the piezoelectric layer along the outer periphery of each of the pressure chambers. Accordingly, since the first groove is up to the piezoelectric layer, the stiffness of the piezoelectric layer is decreased. Therefore, it is possible to further substantially deform the area of the piezoelectric actuator facing the pressure chambers. Moreover, when the driving signal is supplied to an individual electrode, the partial deformation of the piezoelectric actuator at a portion facing the pressure chamber corresponding to the individual electrode is hardly propagated to a portion of the piezoelectric actuator facing a pressure chamber adjacent to the pressure chamber. Therefore, it is possible to further suppress the cross-talk. It is enough that at least a part of the piezoelectric layer is removed.

In the method of producing the liquid jetting head of the present invention, in the individual-electrode forming step, the second groove may be formed by removing the piezoelectric layer along a direction in which the first groove is extended. Accordingly, since the second groove is up to the piezoelectric layer, the stiffness of the piezoelectric layer is decreased. Therefore, it is possible to substantially deform the area of the piezoelectric actuator facing the pressure chamber. It is enough that at least a part of the piezoelectric layer is removed.

In the method of producing the liquid jetting head of the present invention, in the individual-electrode forming step, each of the individual electrodes may be formed to have a doughnut-shape by forming the first groove and the second groove each having a circular shape. Accordingly, it is possible to substantially deform the plate and the piezoelectric layer in a ring-shaped area, of the piezoelectric actuator, facing the periphery of each of the pressure chambers.

In the method of producing the liquid jetting head of the present invention, the pressure chambers may be long in one direction; and in the individual-electrode forming step, each of the individual electrodes may be formed to have two areas mutually extending in parallel along the one direction and sandwiching the central portion of one of the pressure chambers, by forming the first groove and the second groove extended in the one direction. Accordingly, the plate and the piezoelectric layer are substantially deformed in the piezoelectric actuator at areas facing portions along the periphery of each of the pressure chambers in the one direction.

In the method of producing the liquid jetting head of the present invention, in the first-recess forming step and the individual-electrode forming step, one of the electroconductive layer and the piezoelectric layer may be removed by irradiating a laser beam. Accordingly, it is possible to remove the electroconductive layer and/or the piezoelectric layer by an easy method such as irradiating the laser beam, and to form the first groove, the second groove, and the first recess.

The method of producing the liquid jetting head of the present invention may further include a second-recess forming step for forming by etching a second recess which opens toward the pressure chamber, in the plate at an area facing each of the pressure chambers. Accordingly, since the second recess is formed in the plate such as the vibration plate, at an area facing each of the pressure chambers, stiffness of the area of the plate in which the recess is formed is decreased to be less than stiffness of the other area of the plate. Therefore, it is possible to deform further substantially the area of the piezoelectric actuator facing each of the pressure chambers.

In the method of producing the liquid jetting head of the present invention, the pressure chambers may be long in one direction; and in the second-recess forming step, the second recess may be formed in the plate at an area facing a central portion of each of the pressure chambers to extend along the one direction. Accordingly, even though the pressure chambers are extended in the one direction, it is possible to substantially deform the piezoelectric actuator in accordance with the pressure chambers.

In the method of producing the liquid jetting head of the present invention, in the second-recess forming step, the second recess may be formed in the plate to extend in a ring-shape along the outer periphery of each of the pressure chambers. Accordingly, since stiffness of the plate such as the vibration plate in an area facing the periphery of the pressure chamber is decreased rather than in the other area, it is possible to further substantially deform the area of the piezoelectric actuator facing each of the pressure chambers. Moreover, when the driving signal is supplied to the individual electrode, a partial deformation of the piezoelectric actuator facing the pressure chamber is hardly propagated to a portion of the piezoelectric actuator facing another pressure chamber adjacent to the pressure chamber. Therefore, it is possible to suppress the cross-talk.

BRIEF DESCRIPTION OF THE DRAWINGS

FIG. 7A is a step for providing a channel unit in which the pressure chambers are formed; FIG. 7B is a step for forming a piezoelectric layer; FIG. 7C is a step for forming an electroconductive layer; FIG. 7D is a step for forming an individual electrode and a first recess; and FIG. 7E is a step for adhering a nozzle plate to the channel unit;

DETAILED DESCRIPTION OF PREFERRED EMBODIMENTS

First Embodiment

Figure 1:
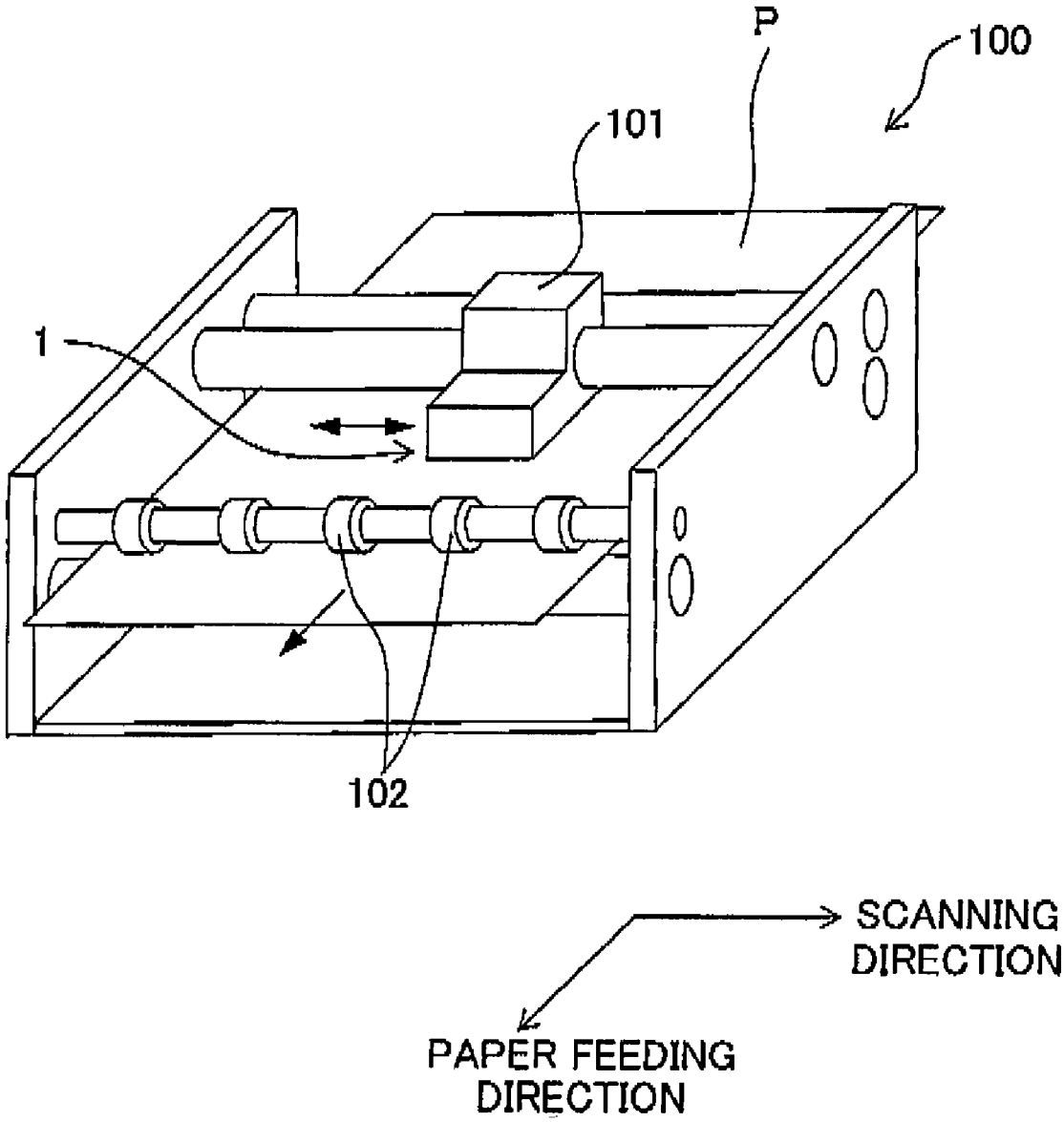
FIG. 1 is a schematic perspective view of an ink-jet printer in which an ink-jet head according to a first embodiment of the present invention is adopted.
Figure 2:
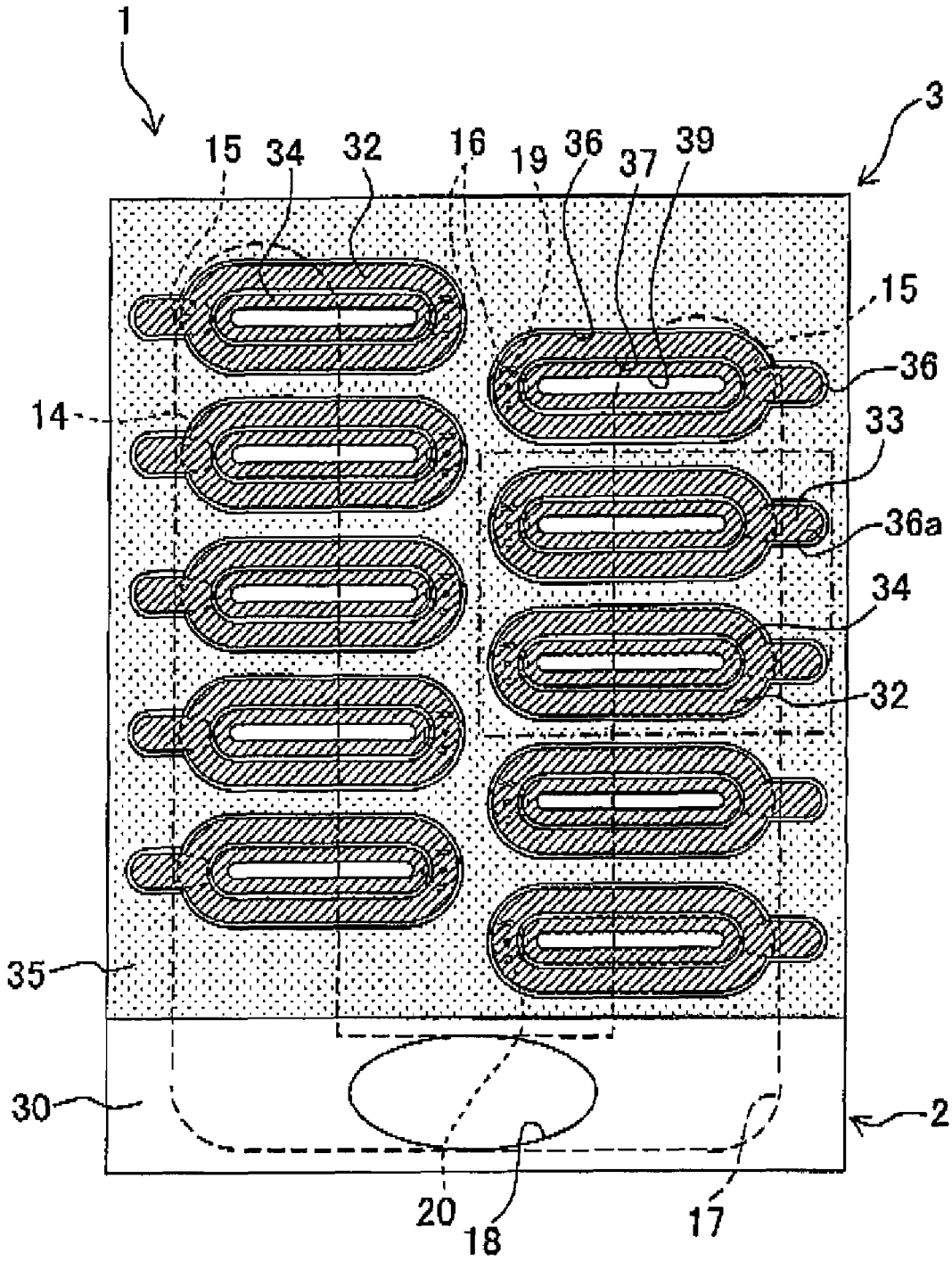
FIG. 2 is a plan view of the ink-jet head.

A first embodiment of the present invention will be described below. The first embodiment is an example in which the present invention is applied to an ink-jet head as a liquid jetting head, which jets an ink onto a recording paper from a nozzle. FIG. 1 is a schematic perspective view of an ink-jet printer in which the ink-jet head according to the first embodiment of the present invention is adopted. As shown in FIG. 1, an ink-jet printer 100 includes a carriage 101 which is movable in a scanning direction (left and right direction in FIG. 1), an ink-jet head 1 of serial type which is provided on the carriage 101 and jets ink onto a recording paper P, and transporting rollers 102 which transport or feed the recording paper P in a paper feeding direction (forward direction in FIG. 1). The ink-jet head 1 moves integrally with the carriage 101 in the scanning direction (left and right direction), and jets ink onto the recording paper P from nozzles 20 (see FIG. 4) which are formed in an ink jetting surface which is a lower surface of the ink-jet head. The recording paper P with an image recorded thereon by the ink-jet head 1 is jetted forward (paper feeding direction) by the transporting rollers 102.

Next, the ink-jet head 1 will be described in detail referring to FIGS. 2 to 5. As shown in FIGS. 2 to 5, the ink-jet head 1 includes a channel unit 2 in which ink channels are formed, and a piezoelectric actuator 3 which is arranged on an upper side of the channel unit 2.

Figure 4:
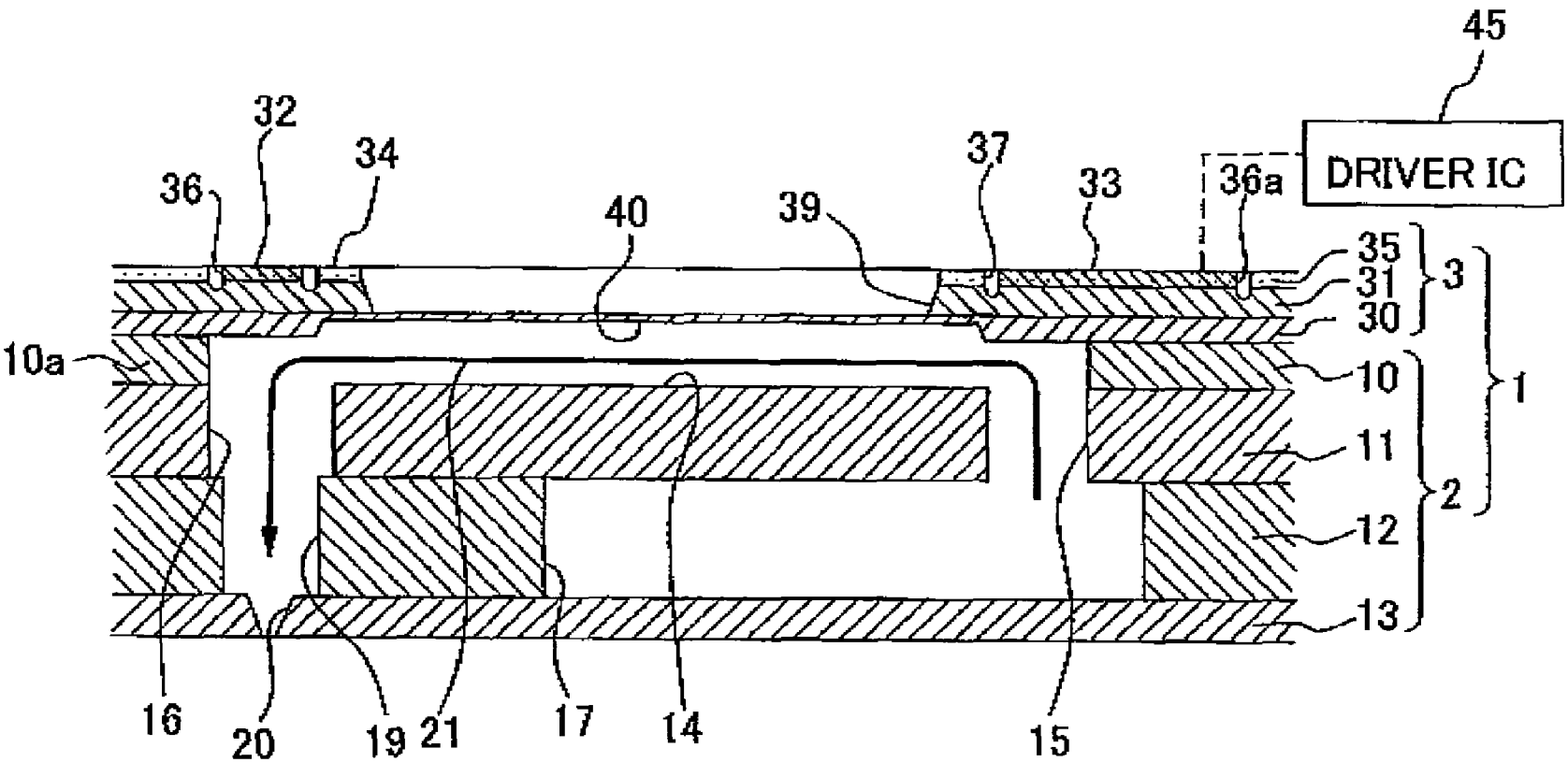
FIG. 4 is a cross-sectional view taken along a line IV-IV shown in FIG. 3.
Figure 5:
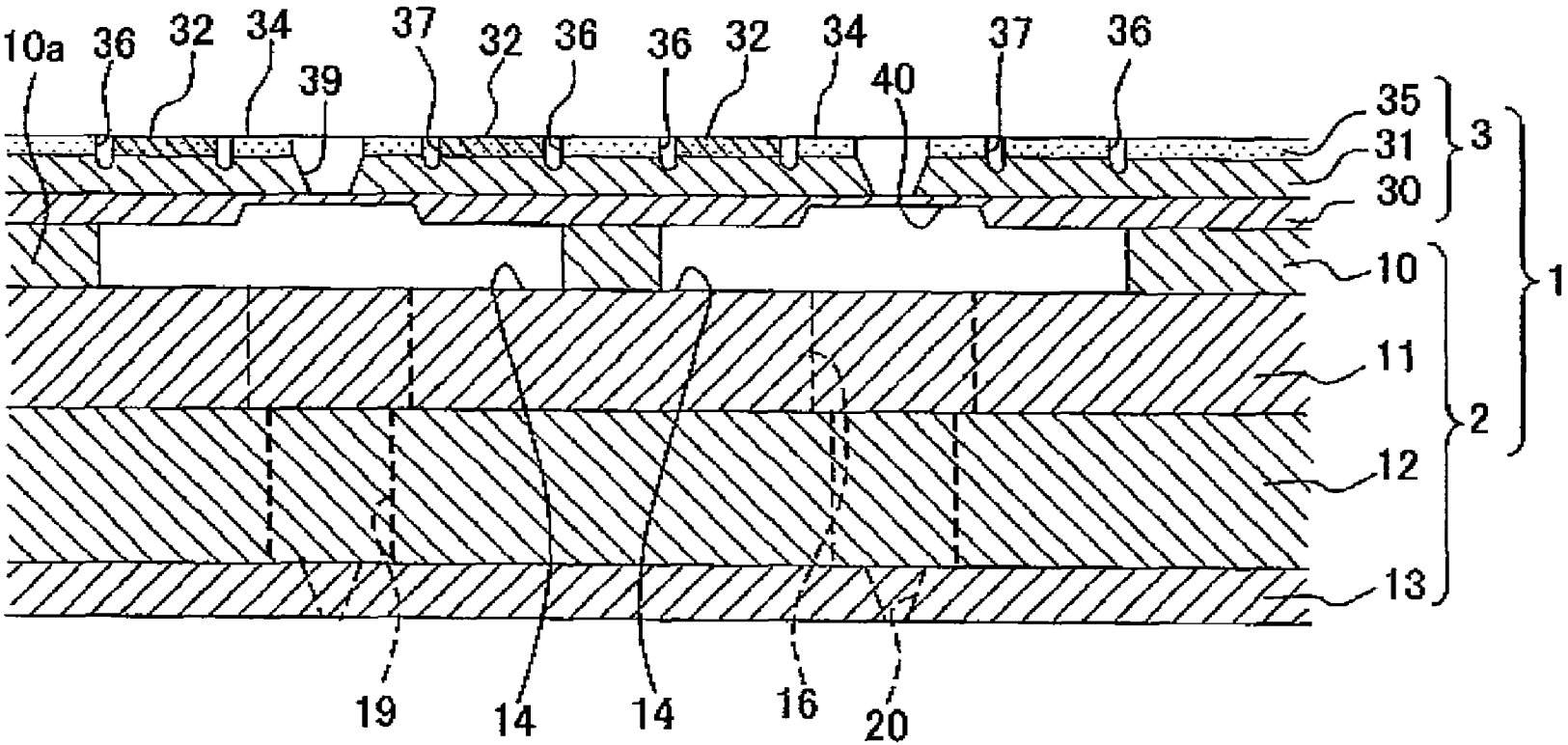
FIG. 5 is a cross-sectional view taken along a line V-V shown in FIG. 3.

Firstly, the channel unit 2 will be described. The channel unit 2, as shown in FIGS. 4 and 5, includes a cavity plate 10, a base plate 11, a manifold plate 12, and a nozzle plate 13, and these four plates 10 to 13 are joined in stacked layers. Among these four plates, the cavity plate 10, the base plate 11, and the manifold plate 12 are substantially rectangular-shaped stainless steel plates. On the other hand, the nozzle plate 13 is formed of a high-molecular synthetic resin material such as polyimide, and is adhered to a lower surface of the manifold plate 12. The nozzle plate 13 may also be formed of a metallic material such as stainless steel, similar to the three plates 10 to 12.

A plurality of pressure chambers 14, which are arranged along an upper surface (plane), are formed in the cavity plate 10, and these pressure chambers 14 are open toward a vibration plate 30 (upper side in FIG. 4) which will be described later. Moreover, the pressure chambers 14 are arranged in two rows in the paper feeding direction (up and down direction in FIG. 2). Each of the pressure chambers 14, in a plan view, is formed to be substantially elliptical (rectangle with round corners) in shape which is long in the scanning direction (left and right direction in FIG. 2). The shape of the pressure chamber in a plan view may be, for example, a rectangular shape long in the scanning direction, an elliptical shape, a rhombus shape, a parallelogram shape, a circular shape, a triangular shape, a square shape, a polygonal shape, or the like.

Moreover, as shown in FIGS. 2 to 5, communicating holes 15 are formed in the base plate 11 at positions each overlapping in a plan view with an outer side end portion, in a longitudinal direction of one of the pressure chambers 14, and communicating holes 16 are formed in the base plate 11 at positions each overlapping in a plan view with an inner side end portion, in the longitudinal direction of one of the pressure chambers 14. Further, a manifold channel 17, which is extended in two rows in the paper feeding direction and which overlaps in a plan view with the outer side end portions in the longitudinal direction of the pressure chambers 14, is formed in the manifold plate 12. An ink is supplied to this manifold channel 17 from an ink tank (not shown in the diagram) via an ink supply port 18 formed in the cavity plate 10 and the vibration plate 30 which will be described later. Moreover, communicating holes 19 are formed in the manifold plate 12, at positions each overlapping in a plan view with the inner side end portion, in the longitudinal direction of one of the pressure chambers 14, the inner side end portion being on a side opposite to the manifold channel 17. The nozzles 20 are formed in the nozzle plate 13, at positions overlapping in a plan view with the communicating holes 19, respectively. The nozzles 20 are formed by performing an excimer laser processing on a substrate of a high-molecular synthetic resin material such as polyimide.

Moreover, as shown in FIG. 4, the manifold channel 17 communicates with the pressure chambers 14 via the communicating holes 15 respectively, and each of the pressure chambers 14 communicate with one of the nozzles 20 via the communicating holes 16 and 19. Thus, a plurality of individual ink channels (individual liquid channels) 21 each from the manifold channel 17 to one of the nozzles 20 via one of the pressure chambers 14 are formed inside the channel unit 2.

Next, the piezoelectric actuator 3 will be described. As shown in FIGS. 2 to 5, the piezoelectric actuator 3 includes the vibration plate 30 which is electroconductive, which has a substantially rectangular shape, and which is arranged on an entire upper surface of the channel unit 2, a piezoelectric layer 31 which is formed in the vibration plate 30 on an upper surface thereof (surface on a side opposite to the pressure chambers 14) and which continuously covers all the pressure chambers 14, a plurality of individual electrodes 32 which are formed on an upper surface (surface on a side opposite to the vibration plate 30) of the piezoelectric layer 31, corresponding to the pressure chambers 14 respectively, and an electroconductive layer 35 which is formed, on an upper surface of the piezoelectric layer 31, to be isolated from the individual electrodes 32.

The vibration plate 30 is made of a metallic material such as an iron alloy like stainless steel, a nickel alloy, an aluminum alloy, and a titanium alloy. The vibration plate 30 is joined to partition walls 10*a*, of the cavity plate 10, which define the pressure chambers 14 while covering the pressure chambers 14. The vibration plate 30 is arranged facing the individual electrodes 32, and serves also as a common electrode which makes an electric field act in portions of the piezoelectric layer 31 between the individual electrode 32 and the vibration plate 30. The vibration plate 30 is kept at a ground electric potential by being connected to a ground terminal. The vibration plate 30 in the first embodiment is entirely electroconductive. However, only an uppermost layer of the vibration plate may be electroconductive. In other words, the vibration plate may be formed of not less than two layers, and at least the uppermost layer among these layers may be electroconductive.

Moreover, as shown in FIGS. 4 and 5, a recess 40 (second recess) which is open toward each of the pressure chambers 14 is formed on the lower surface (surface on a side of the pressure chambers 14) of the vibration plate 30. The recesses 40, having a substantially elliptical shape and long in the scanning direction and which is smaller to some extent than the pressure chamber 14 as a whole, are formed in areas each overlapping in a plan view with a central portion of one of the pressure chambers 14. Moreover, a thickness of the vibration plate 30, at the areas thereof in which the recesses 40 are formed respectively, is reduced to be less than a thickness of the other portion of the vibration plate 30, and the stiffness of the vibration plate 30 is partially decreased in these areas.

The piezoelectric layer 31 is mainly composed of lead zirconate titanate (PZT) which is a solid solution of lead titanate and lead zirconate and is a ferroelectric substance. The piezoelectric layer 31 is formed to cover all the pressure chambers 14. Therefore, it is possible to form the piezoelectric layer 31 at a time for all the pressure chambers 14, and the formation of the piezoelectric layer 31 becomes easy.

Figure 3:
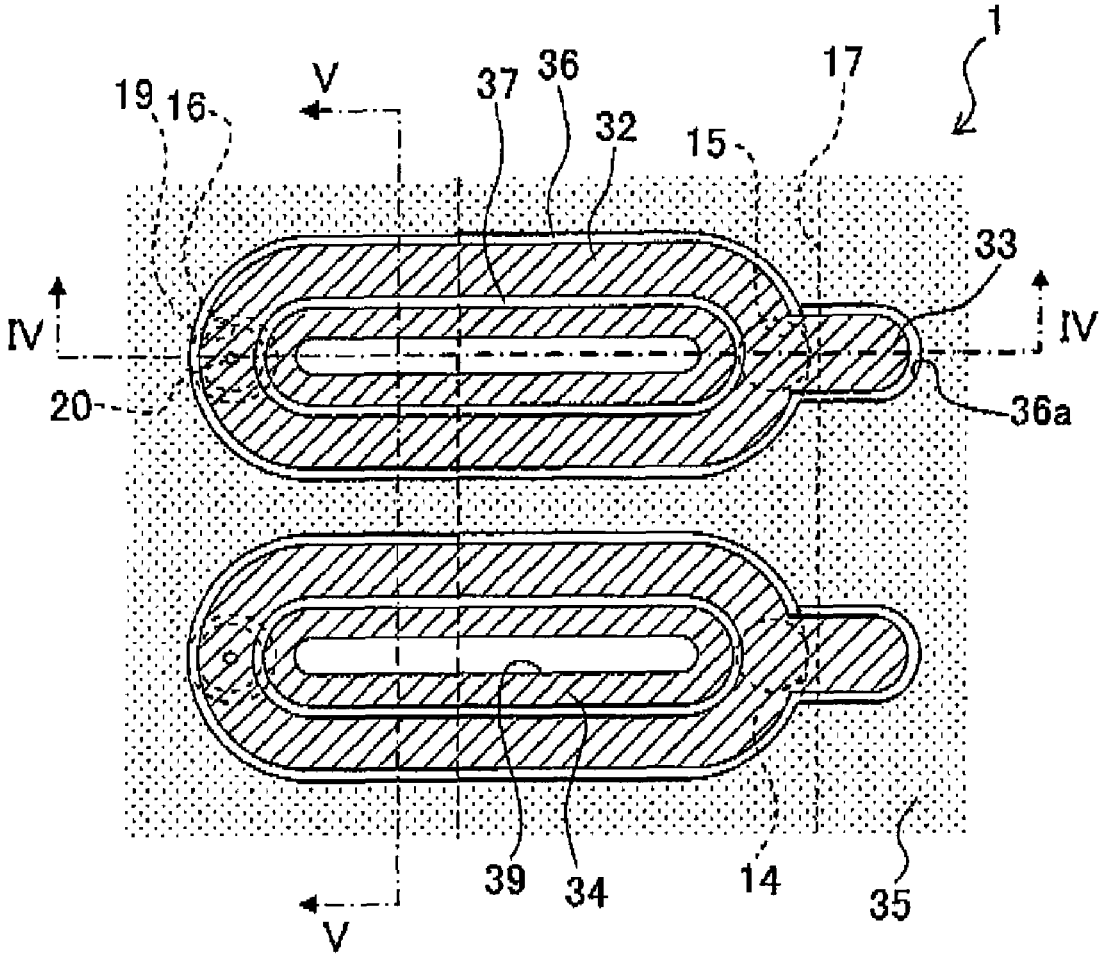
FIG. 3 is an enlarged plan view of an area, surrounded by an alternate long and short dash line and shown in FIG. 2.

As shown in FIGS. 3 to 5, an outer groove (first groove) 36 which is extended in a ring-shape (circular shape) along the periphery of each of the pressure chambers 14, and an inner groove (second groove) which is extended in a ring-shape (circular shape) along the outer groove 36, inside of the outer groove 36 are formed in the upper surface of the piezoelectric layer 31, at an area overlapping in a plan view with the periphery of each of the pressure chambers 14. The outer groove 36 has a curved portion (loop-hooked portion) 36*a* which is curved outward in the scanning direction in the vicinity of an area overlapping in a plan view with one of the communicating holes 15. The curved portion 36*a* is formed in the upper surface of the piezoelectric layer 3, at an area not overlapping with any of the pressure chambers 14 (in other words, an area overlapping with one of the partition walls 10*a* of the piezoelectric actuator 3). The inner groove 37 is formed in the upper surface of the piezoelectric actuator 3, along an area overlapping with a periphery of each of the recesses 40 formed in the vibration plate 30. As shown in FIGS. 4 and 5, the depth of the outer groove 36 and the depth of the inner groove 37 are such that the grooves penetrate through the electroconductive layer 35 to reach into the piezoelectric layer 31. Moreover, a recess (first recess) 39, having a substantially rectangular shape and being long in the scanning direction, is formed, in the surface of the piezoelectric actuator 3, at an area (predetermined area) inside the inner groove 37, the area overlapping with the central portion of each of the pressure chambers 14. In other words, the recess 39 is formed, in the surface of the piezoelectric actuator 3, at an area overlapping in a plan view with one of the recesses 40 formed in the vibration plate 30. Moreover, as shown in FIGS. 4 and 5, the recess 39 is formed to penetrate through the electroconductive layer 35 and the piezoelectric layer 31. Therefore, a portion of the upper surface of the vibration plate 30 is exposed through an opening of the recess 39. Consequently, the recess 39 in the first embodiment is deeper than the inner groove 36 and the outer groove 37.

By forming such inner groove 36 and the outer groove 37, each of the individual electrodes 32 is formed in the upper surface of the piezoelectric layer 31 to be ring-shaped along the periphery, at an area other than the central portion of one of the pressure chambers 14, in other words, at an area overlapping with the periphery of one of the pressure chambers 14. Moreover, each of the individual electrodes 32 includes a terminal 33 which is extended outward in the scanning direction, and formed by the curved portion 36*a* of the outer groove 36. The terminal 33 is connected to a driver IC 45 via a flexible wiring member (omitted in the diagram) such as a flexible printed circuit (FPC), and the driving signal is selectively supplied from this driver IC 45 to the individual electrodes 32 via a plurality of terminals 33 respectively. In the first embodiment, since the electroconductive layer 35 is formed of copper, the individual electrodes 32 are also formed of copper. However, the electroconductive layer 35 and the individual electrodes 32 may be formed of an electroconductive material such as gold, silver, palladium, platinum, titanium, and the like. Moreover, by the inner groove 37, a dummy electrode 34 isolated from each of the individual electrodes 32 is formed inside of each of the individual electrodes 32. The dummy electrode 34 is formed by the recess 39 to be ring-shaped similar to the individual electrode 32.

Figure 6:
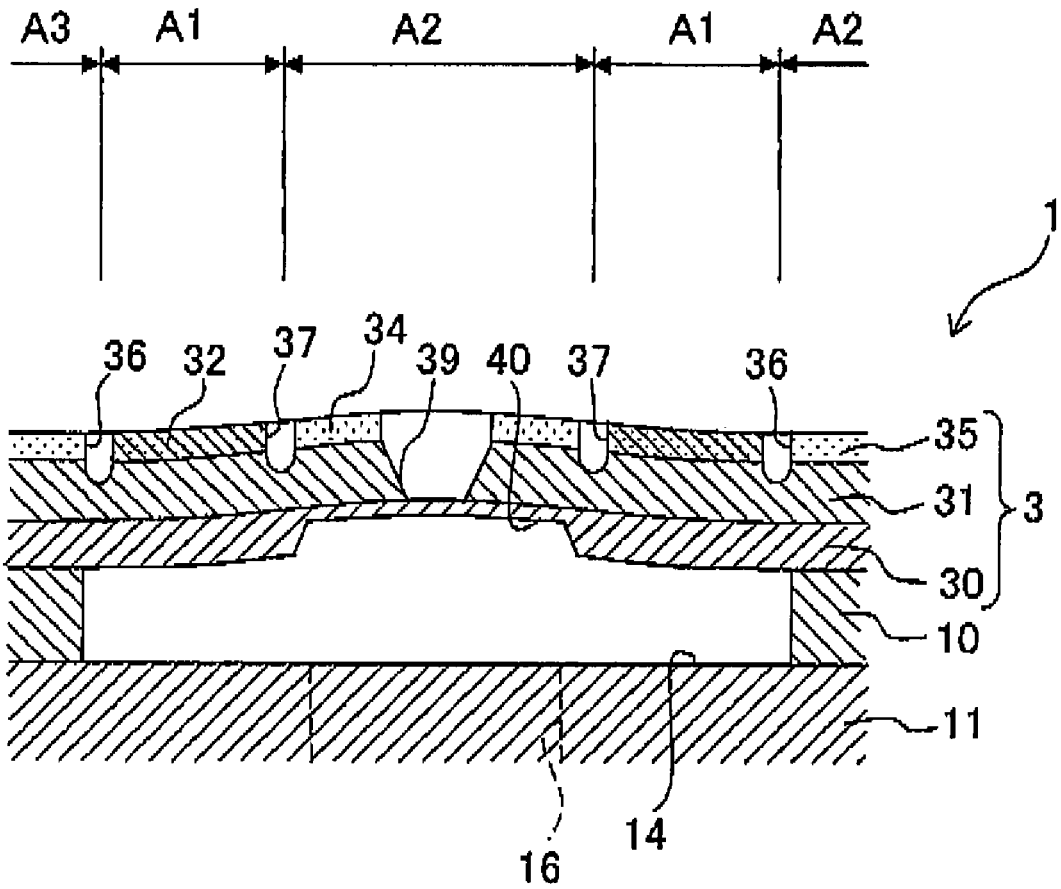
FIG. 6 is a diagram showing a deformed state of a piezoelectric actuator when the piezoelectric actuator is driven.

Next, an action of the piezoelectric actuator 3 at the time of ink-jetting will be explained. FIG. 6 is a diagram showing a deformed state of the piezoelectric actuator 3. When the driving signal (positive electric potential) is selectively applied from the driver IC 45 to a desired individual electrode 32, an electric potential of the individual electrode 32 to which the driving signal is supplied and an electric potential of the vibration plate 30 serving as the common electrode kept at the ground electric potential differ from each other, thereby generating an electric field in a direction of a thickness of the piezoelectric layer 31 in a ring-shaped portion of the piezoelectric layer 31 along the periphery of the pressure chamber 14 and sandwiched between the individual electrode 32 and the vibration plate 30. At this time, when the direction of the electric field is same as a direction in which the piezoelectric layer 31 is polarized, the piezoelectric layer 31 is elongated in the thickness direction in which the piezoelectric layer 31 is polarized, and the piezoelectric layer 31 is contracted in a direction parallel to a plane of the piezoelectric layer 31, which is a direction orthogonal to the direction in which the piezoelectric layer 31 is polarized.

Here, as described above, since the individual electrode 32 is formed, on the piezoelectric layer 31, at the ring-shaped area overlapping with the periphery of the pressure chamber 14, as shown in FIG. 6, the ring-shaped area of the piezoelectric actuator 3 along the periphery of the pressure chamber 14 becomes a driving zone A1 (active zone) in which the piezoelectric layer 31 by itself deforms, and an area overlapping with the central portion of the pressure chamber 14 becomes a driven zone A2 (inactive zone) which is deformed along with the deformation of the piezoelectric layer 31 in the driver zone A1. Moreover, an area in the piezoelectric actuator 3, which overlaps with an area outside the pressure chamber 14 and at which the vibration plate 30 is joined to the cavity plate, becomes a constrained zone A3 in which the deformation of the vibration plate 30 is constrained. Furthermore, as shown in FIG. 6, the piezoelectric layer 31 in the driving zone A1 positioned at both sides of the driven zone A2 is contracted in the direction parallel to the plane of the piezoelectric layer 31, whereas the vibration plate 30 in the driving zone A1 is not contracted in the direction parallel to the plane of the piezoelectric layer 31. Due to this, the vibration plate 30 and the piezoelectric layer 31 in the driven zone A2 surrounded by the driving zone A1 are deformed, and thus the vibration plate 30 is deformed to project toward the side opposite to the pressure chamber 14, with a center of the driven zone A2 as an apex (unimorph deformation). As the vibration plate 30 is deformed, a volume in the pressure chamber 14 is increased, and a negative pressure wave is generated in the pressure chamber 14.

When time elapses, the time taken by the pressure wave generated due to the increase in the volume of the pressure chamber 14 for one way propagation in the longitudinal direction of the pressure chamber 14, the pressure in the pressure chamber 14 is changed to a positive (pressure wave). At this point, at the timing of change of the pressure in the pressure chamber 14 to the positive, the driver IC 45 stops applying the driving signal to the individual electrode 32, the electric potential of the individual electrode 32 becomes the ground electric potential, and the vibration plate 30 restores its original shape, thereby decreasing the volume inside the pressure chamber 14. At this time, the positive pressure wave reversed from the negative pressure wave due to the increase in the volume inside the pressure chamber 14, as described above, and a pressure wave generated due to restoration of the vibration plate 30 to the original shape are combined, so as to apply a substantial pressure to the ink in the pressure chamber 14, thereby jetting the ink from the nozzle 20. Thus, a predetermined printing is performed on the recording paper P.

Figure 17:
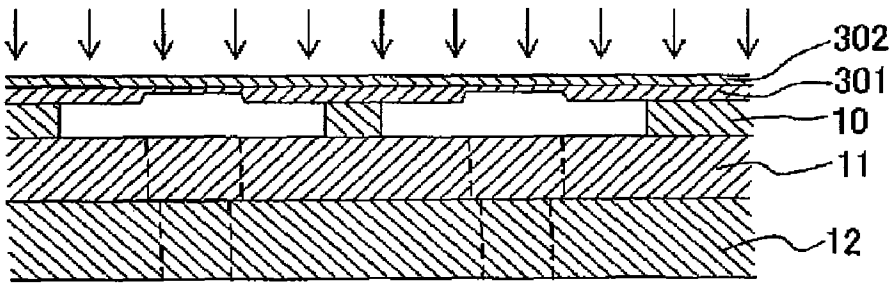
FIG. 17 is diagram showing a step for forming a vibration plate in the ink-jet head of the present invention.

Next, a method of producing the ink-jet head 1 will be explained, referring to FIGS. 7A to 7E. FIGS. 7A to 7E are a producing process diagrams showing for an ink-jet head 1. For producing the ink-jet head 1, firstly, a photoresist which is patterned is formed as a mask on the three plates 10 to 12, excluding the nozzle plate 13, among the plates 10 to 13 constructing the channel unit 2, and holes, as shown in FIGS. 4 and 5, are formed in each of the plates 10 to 12 by performing etching. Next, the vibration plate 30 which is entirely electroconductive is prepared. In the first embodiment, since the vibration plate 30 is made of an electroconductive material, there is no need to perform any special processing. However, in a case in which a substrate, which is to be a vibration plate, is made of a non-electroconductive material, or in a case in which a surface (upper surface), of the substrate which is to be a vibration plate, on a side opposite to the cavity plate 10 when the substrate is stacked on the cavity plate 10, is non-electroconductive, as shown in FIG. 17, an electroconductive layer 302 made of an electroconductive material is formed on an upper surface of a substrate 301 by a method such as a vapor deposition method (plate-forming step, vibration plate-forming step). Accordingly, the vibration plate (plate) 30 having an electroconductive upper surface is formed. Next, on the lower surface (surface to be joined to the cavity plate 10) of the vibration plate 30, the recesses 40 open toward the pressure chambers 14 as shown in FIG. 4 and FIG. 5 is formed in the vibration plate 30 by performing patterning the photoresist, and by etching the photoresist as a mask (second-recess forming step).

Figure 7A:
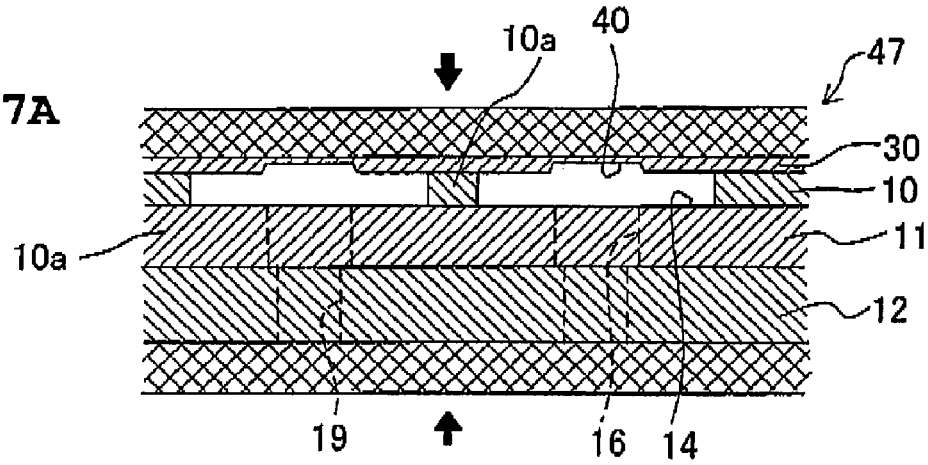
FIGS. 7A to 7E are diagrams showing production steps for the ink-jet head according to the first embodiment of the present invention.

Next, as shown in FIG. 7A, the three plates 10 to 12 are stacked in this order, and the vibration plate 30 is arranged such that the openings of the recesses 40 in the vibration plate 30 are open toward the pressure chambers 14 respectively; and the vibration plate 30 is stacked on the upper surface of the cavity plate 10 such that each of the recesses 40 overlaps with the central portion of one of the pressure chambers 14 in the cavity plate 10. Next, the three plates 10 to 12 and the vibration plate 30, which are stacked, are heated to a predetermined temperature, and the three plates 10 to 12 and the vibration plate 30 are pressurized by clamping with a jig 47 constructed of a pair of upper and lower plates. Thus, the three plates 10 to 12 are diffusion-bonded to one another, and the partition walls 10*a* of the cavity plate 10 and the vibration plate 30 are diffusion-bonded. The three plates 10 to 12 and the vibration plate 30 may be joined with an adhesive.

Figure 7B:
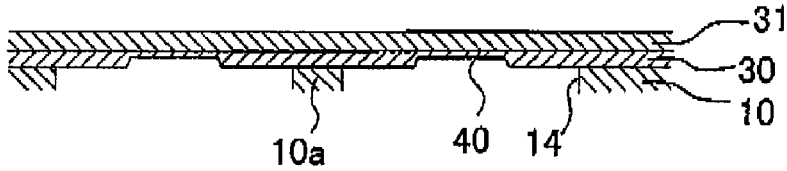
Figure 7C:
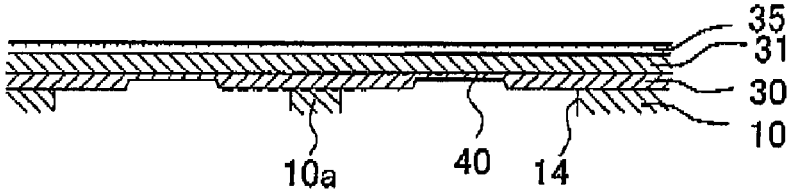

Next, as shown in FIG. 7B, the piezoelectric layer 31 which is continuous without a gap is formed on the upper surface of the vibration plate 30, so as to cover all the pressure chambers 14. Here, in the piezoelectric-layer forming step 31, the piezoelectric layer 31 is formed by depositing particles of PZT from above the vibration plate 30, on the upper surface of the vibration plate 30, by a method such as a chemical vapor deposition (CVD method) and an aerosol deposition (AD method). Moreover, the piezoelectric layer 31 can also be formed by a method such as a sol-gel method, a sputtering method, and a hydrothermal synthesis method, and further, the piezoelectric layer 31 can also be formed by adhering, on the upper surface of the vibration plate 30, a piezoelectric sheet which is obtained by baking a green sheet of the PZT. Next, as shown in FIG. 7C, the electroconductive layer 35 is formed without a gap on the entire upper surface of the piezoelectric layer 31 by a method such as a screen printing method, the vapor deposition method, and the sputtering method (electroconductive-layer forming step). The electroconductive layer 35 can also be formed by a method such as the CVD method and the AD method.

Figure 7D:
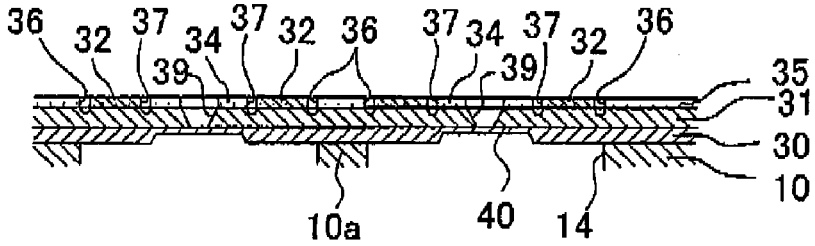

Next, a laser beam is irradiated from above the electroconductive layer 35, onto an area which is on the upper surface of the electroconductive layer 35 and which overlaps in a plan view with the periphery of each of the pressure chambers 14, and as shown in FIG. 7D, the electroconductive layer 35 is penetrated through. Further, portions of the piezoelectric layer 31 are removed to form the outer grooves 36 having a ring-shape. At this time, a curved portion 36*a* which is curved outward in the scanning direction is also formed in the upper surface of the electroconductive layer 35, in the vicinity of an area overlapping in a plane view with one of the communicating holes 15. Next, the laser beam is irradiated onto the upper surface of the electroconductive layer 35 at portions inside each of the outer grooves 36 along the outer groove 36, and as shown in FIG. 7D, the electroconductive layer 35 is penetrated through, thereby forming the inner grooves 37 having a ring-shape by removing portions of the piezoelectric layer 31. By forming the outer grooves 36 and the inner grooves 37, the individual electrodes 32 having a ring-shape, and isolated from the electroconductive layer 35 (in other words, insulated from the electroconductive layer 35), are formed on the surface of the piezoelectric layer 31, at the areas each overlapping with the periphery of one of the pressure chambers 14 (individual-electrode forming step). Further, by irradiating the laser beam on the upper surface of the electroconductive layer 35, at an area (predetermined area) inside of each of the inner grooves 37, and overlapping with the central portion of each of the pressure chambers 14 so as to remove, as shown in FIG. 7D, the electroconductive layer 35 and the piezoelectric layer 31 such that a portion of the upper surface of the vibration plate 30 is exposed, thereby forming the recess 39 having a substantially elliptical shape in a plan view (first-recess forming step). When the recess 39 is formed, power of the laser beam is intensified to be more than power of the laser beam at the time of forming the outer groove 36 and the inner groove 37, or time for irradiating the laser beam is prolonged. By forming the inner grooves 37 and the recesses 39, dummy electrodes 34 having a ring-shape are formed each inside of one of the individual electrodes 32. Thus, it is possible to form the outer grooves 36 and the inner grooves 37 which form the individual electrodes 32 respectively, by a simple method of laser processing.

Figure 7E:
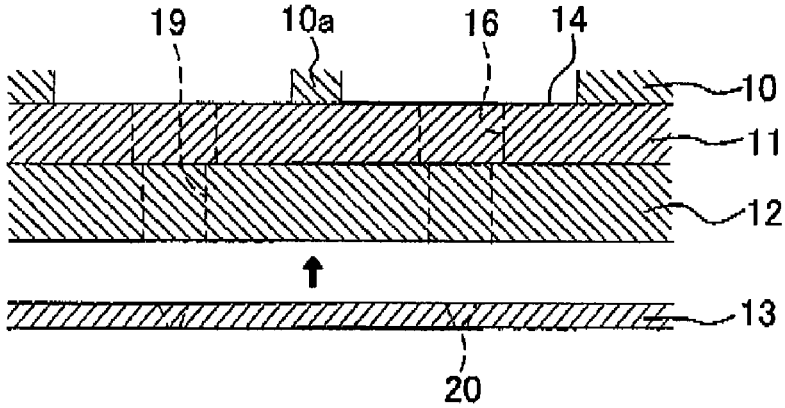

Next, the nozzle plate 13 in which the nozzles 20 are formed by the laser processing is positioned such that each of the nozzles 20 and each of the communicating holes 19 face mutually as shown in FIG. 7E, and the nozzle plate 13 is adhered to the lower surface of the manifold plate 12, thereby completing the production of the ink-jet head 1.

As described above, according to the ink-jet head 1 according to the first embodiment, the piezoelectric actuator 3 is capable of applying the substantial pressure to the ink in the pressure chamber 14. Consequently, it is possible to apply a high pressure to the ink with a driving signal at a low voltage, and drive efficiency of the piezoelectric actuator 3 is improved. Moreover, since the electric field is generated in the piezoelectric layer 31 by supplying the drive voltage between the individual electrodes 32 and the vibration plate 30 which is a common electrode only at a timing of jetting the ink, the polarization degradation hardly occurs in the piezoelectric layer 31, and the durability of the piezoelectric actuator 3 is improved substantially.

The individual electrodes 32 are each formed to be ring-shaped along the periphery of the pressure chamber 14, on the upper surface of the piezoelectric layer 31, at a ring-shaped area overlapping with the periphery of the pressure chamber 14. Accordingly, the piezoelectric layer 31 is deformed throughout the circumference of the ring-shaped areas in which the individual electrodes 32 are formed, respectively. Therefore, an amount of deformation of the vibration plate 30 due to the deformation of the piezoelectric layer 31 is great as compared to a case in which the individual electrodes 32 are formed only in a portion of the ring-shaped areas. As a matter of course, as the amount of deformation of the piezoelectric layer 31 and the vibration plate 30 is greater, it is possible to apply a higher pressure to the ink with a driving signal at a lower voltage, thereby increasing the drive efficiency of the piezoelectric actuator 3. For increasing the amount of deformation of the piezoelectric layer 31 and the vibration plate 30 to be a substantial amount, it is effective to decrease as much as possible stiffness of the vibration plate 30 and the piezoelectric layer 31 in the driven zone A2 on the upper surface of the piezoelectric layer 31 (or the electroconductive layer 35), in which no individual electrodes 32 are formed. Therefore, in the ink-jet head 1 of the first embodiment, as shown in FIG. 6, the recesses 39 smaller to some extent than the pressure chambers 14 as a whole in a plane view are formed on the upper surface (surface on the side opposite to the pressure chambers 14) of the piezoelectric layer 31, at the areas each overlapping with the central portion of one of the pressure chambers 14. Furthermore, the recesses 40 smaller to some extent than the pressure chambers 14 as a whole in a plane view are formed on the lower surface (surface on the side of the pressure chambers 14) of the vibration plate 30, at the areas each overlapping with the central portion of one of the pressure chambers 14. In other words, in the driven zones A2 each overlapping with the central portion of one of the pressure chambers 14, the thickness of the piezoelectric layer 31 and the vibration plate 30 is less or reduced as compared to a thickness of the other portions of the piezoelectric layer 31 and the vibration plate 30, and stiffness of the portions of the piezoelectric layer 31 and the vibration plate 30 in which the recesses 39 and 40 are formed is substantially less or reduced as compared to the portions in which no recesses 39 and 40 are formed. Consequently, when portions, of the piezoelectric layer 31 corresponding to the driving zone A1 is deformed upon the driving signal being supplied to the individual electrode 32, portions of the piezoelectric layer 31 and the vibration plate 30 corresponding to the driven zone A2 is easily deformed. It is therefore possible to apply a high pressure to the ink with a driving signal at a low voltage, and drive efficiency of the piezoelectric actuator 3 is improved. Moreover, by lowering the voltage of the driving signal, it is also possible to reduce cost of an electric equipment system such as the driver IC 45 and the FPC which supply the driving signal to the individual electrodes 32. Further, the stiffness of the portions of the piezoelectric layer 31 and the vibration plate 30, in which the recesses 39 and 40 are formed respectively is less than the stiffness of the portions of the piezoelectric layer 31 and the vibration plate 30 in which the recesses 39 and 40 are not formed, as compared to a case in which the stiffness of these portions is the same. As a result, the deformation of the portions of the piezoelectric layer 31 and the vibration plate 30 in which the recesses 39 and 40 are formed respectively, is hardly propagated to portions of the piezoelectric layer 31 and the vibration plate 30 which are joined to the cavity plate 10 and in which the recesses 39 and 40 are not formed. Consequently, it is possible to suppress the deformation of the portion, of the piezoelectric layer 31 and the vibration plate 30, corresponding to a certain pressure chamber from propagating to a portion corresponding to another pressure chamber 14 adjacent to this pressure chamber, thereby reducing the cross-talk.

Moreover, since the recesses 39 are formed to penetrate not only through the electroconductive layer 35 but also through the piezoelectric layer 31, stiffness of areas of the piezoelectric layer 31, each overlapping with the central portion of one of the pressure chambers 14, are further decreased. Therefore, the amount of deformation of the areas of the piezoelectric actuator 3, overlapping with the pressure chambers 14 respectively, is increased. Moreover, since the recesses 39 are extended in the longitudinal direction of the pressure chambers 14 and corresponding to the pressure chambers 14 which are long in the scanning direction, it is possible to substantially deform the piezoelectric actuator 3. Moreover, since the area (predetermined area) of the piezoelectric actuator 3, in which each of the recesses 39 is formed, overlaps with the central portion of one of the pressure chamber 14, the stiffness of the area of the piezoelectric actuator 3, corresponding to the central portion of the pressure chamber 14, is decreased. Therefore, it is possible to substantially deform the driven zone A2 of the piezoelectric actuator 3.

Moreover, since the recesses 40 are extended in the longitudinal direction of the pressure chambers 14 and corresponding to the pressure chambers 14 which are long in the scanning direction, it is possible to substantially deform the piezoelectric actuator 3

Furthermore, since the outer grooves 36 are formed in the piezoelectric actuator 3 at areas thereof, each overlapping with the periphery of one of the pressure chambers 14, by removing the electroconductive layer 35 and removing a portion of the piezoelectric layer 31, stiffness of the areas of the piezoelectric layer 31, each overlapping with the periphery of one of the pressure chambers 14, is decreased. Therefore, it is possible to substantially deform the areas of the piezoelectric actuator 3, overlapping with the pressure chambers 14 respectively. Moreover, the deformation of an area of the piezoelectric actuator 3, overlapping with a certain pressure chamber 14, is hardly propagated up to another portion corresponding to another pressure chamber 14 adjacent to the pressure chamber 14. Therefore, the cross-talk can be reduced.

Since the inner grooves 37 are formed in the areas of the piezoelectric actuator 3, each overlapping with the periphery of one of the recesses 40, by removing the electroconductive layer 35 and removing the a portion of the piezoelectric layer 31, the stiffness of the areas of the piezoelectric layer 31, each overlapping with the periphery of one of the recesses 40, is decreased. Therefore, it is possible to substantially deform the areas of the piezoelectric actuator 3, overlapping with the pressure chambers 14, respectively.

Second Embodiment

Figure 8:
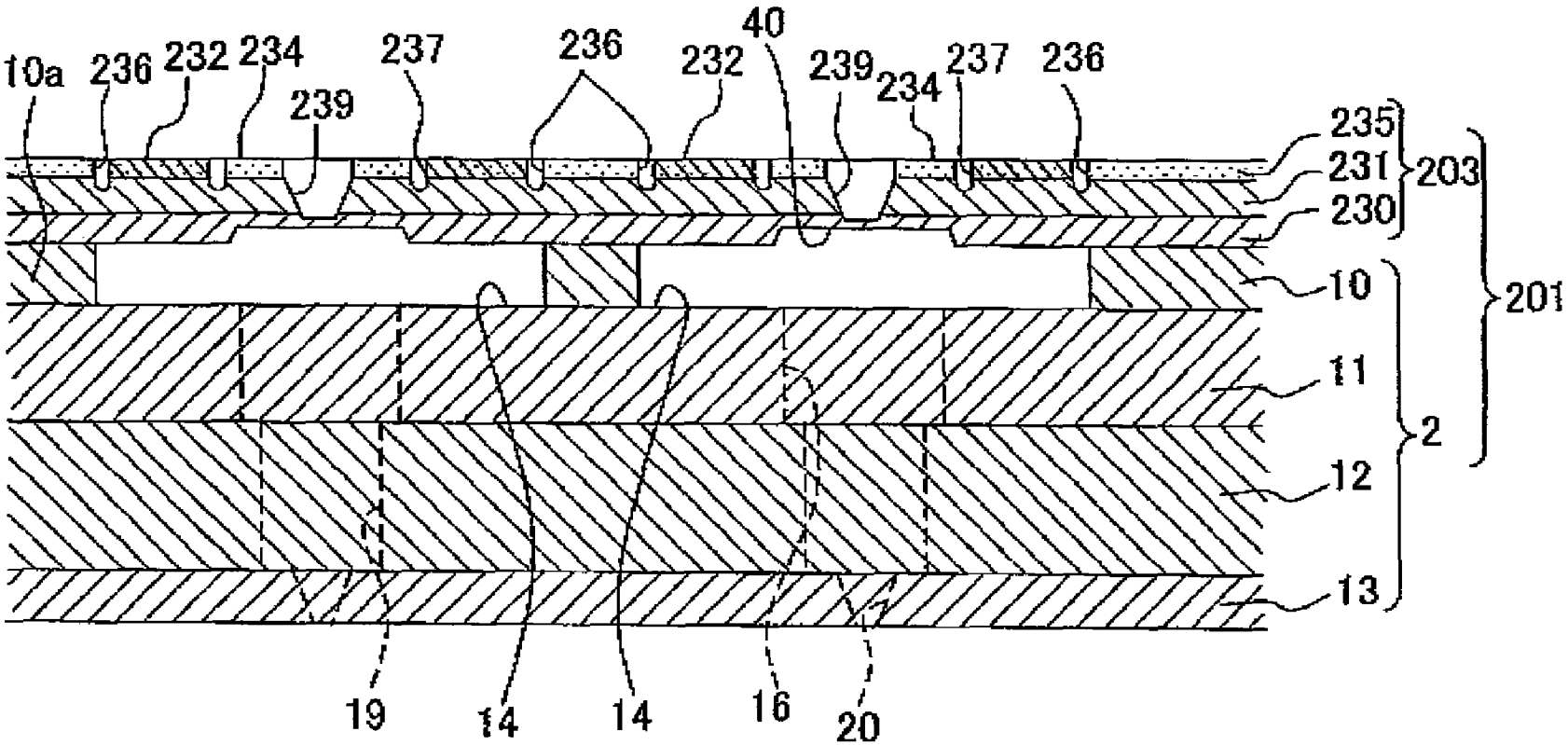
FIG. 8 is a partial cross-sectional view of an ink-jet head according to a second embodiment of the present invention.

Next, an ink-jet head according to a second embodiment of the present invention will be explained referring to FIG. 8. FIG. 8 is a partial cross-sectional view of the ink-jet head. As shown in FIG. 8, an ink-jet head 201 in the second embodiment has a structure substantially similar to the structure of the ink-jet head 1 of the first embodiment, except that the ink-jet head 201 includes a piezoelectric actuator 203 having recesses 239 which formed to be deeper than the recesses 39 in the first embodiment. Therefore, same reference numerals are assigned to parts or components which are similar as those in the first embodiment, and description therefor is omitted.

The piezoelectric actuator 203 includes a vibration plate 230, a piezoelectric layer 231, an electroconductive layer 235, individual electrodes 232, and dummy electrodes 234, which are substantially similar as those in the first embodiment. Outer grooves 236 and inner grooves 237 (first and second grooves) similar as those in the first embodiment, are formed in the piezoelectric actuator 203 by the laser processing. Moreover, a recess 239 (first recess) is formed in the piezoelectric actuator 203, at an area inside of each of the inner grooves 237, the area overlapping with the central portion of each of the pressure chambers 14, by removing with laser processing the electroconductive layer 235, the piezoelectric layer 231, and a portion of the vibration plate 230. In other words, the recess 239 has a depth reaching up to inside of the vibration plate 230, and the recess 239 is deeper than the recess 39 described above. Accordingly, stiffness of an area of the piezoelectric actuator 203 in which the recess 239 is formed is decreased, compared with stiffness of the other area of the piezoelectric actuator 203 (in which the recess 239 is not formed). Therefore, it is possible to substantially deform an area of the piezoelectric actuator 203, overlapping with each of the pressure chambers 14.

Figure 9:
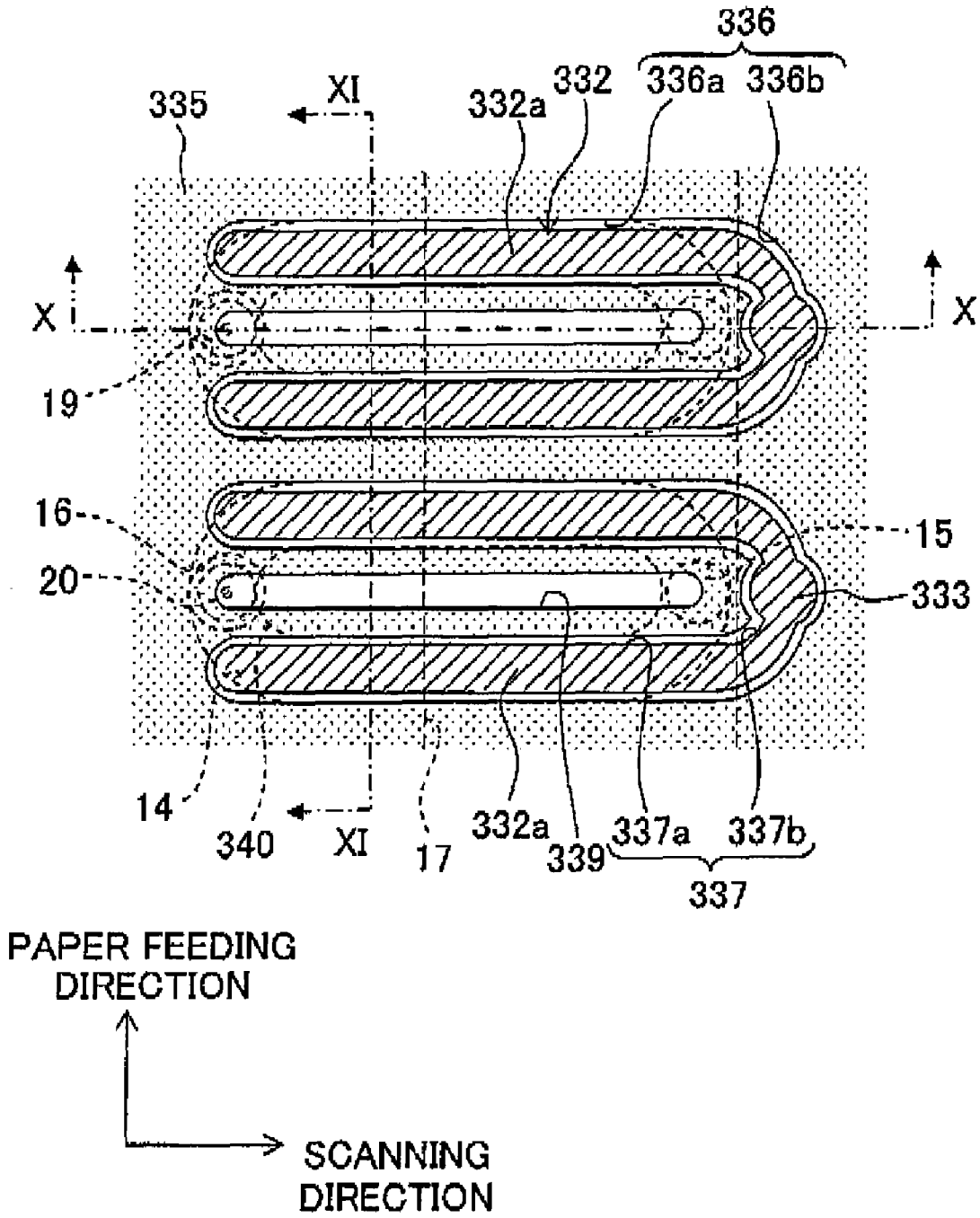
FIG. 9 is a partially enlarged view of an ink-jet head according to a third embodiment of the present invention.
Figure 10:
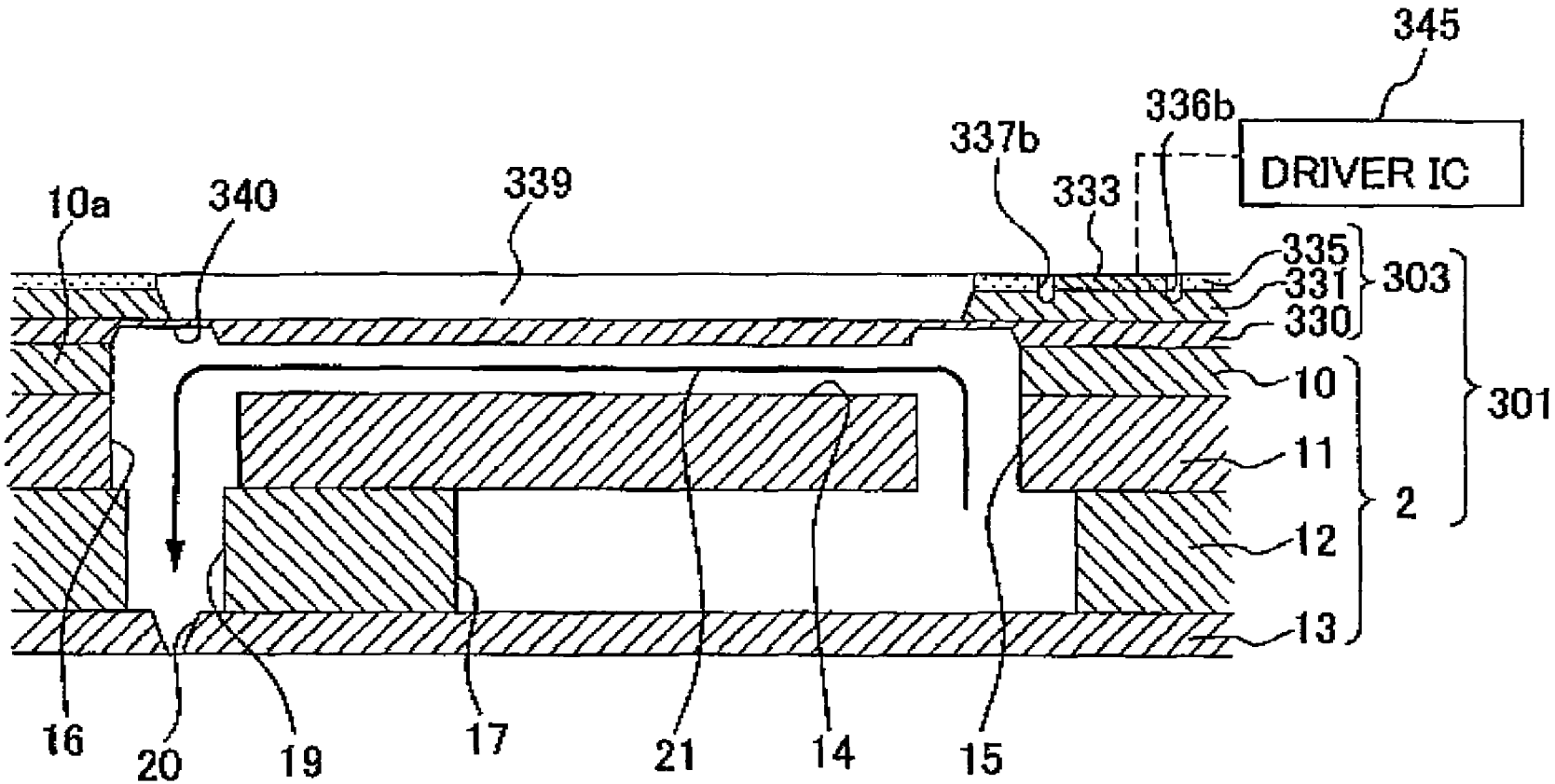
FIG. 10 is a cross-sectional view taken along a line X-x shown in FIG. 9.
Figure 11:
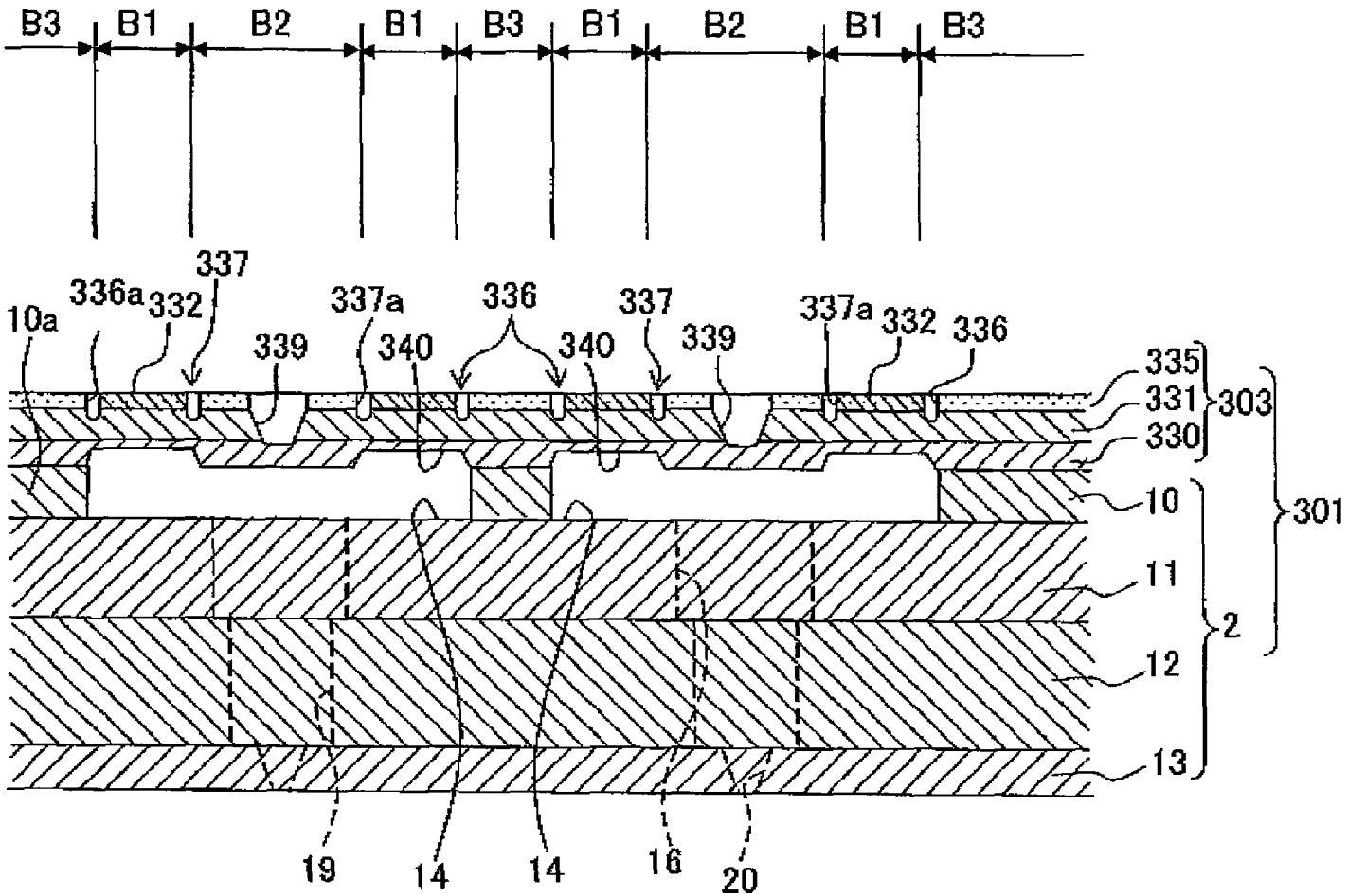
FIG. 11 is a cross-sectional view taken along a line XI-XI shown in FIG. 9.

Next, an ink-jet head according to a third embodiment of the present invention will be explained referring to FIGS. 9 to 11. As shown in FIGS. 9 to 11, an ink-jet head 301 according to the third embodiment includes a channel unit 2 similar as in the first embodiment, and a piezoelectric actuator 303 which is arranged on the upper side of the channel unit 2. As will be described later, a method of producing the ink-jet head 301 is same as the method of producing the ink-jet head 1 in the first embodiment, except for forming a recess (second recess) 340 in a vibration plate 330, an inner groove (first groove) 336, and an outer groove (second groove) 337 to have shapes different from the shapes of the recess 40, the outer groove 36 and the inner groove 37 respectively of the first embodiment.

The piezoelectric actuator 303 includes the vibration plate 330 which is diffusion-bonded on the upper surface of the channel unit 2, a piezoelectric layer 331 which is formed on the upper surface of the vibration plate 330, to continuously cover all the pressure chambers 14, a plurality of individual electrodes 332 which are formed on the upper surface of the piezoelectric layer 331, corresponding to the pressure chambers 14 respectively, and an electroconductive layer 335 which is formed on the upper surface of the piezoelectric layer 331, isolated (insulated) from the individual electrodes 332. A plurality of recesses 340 each open toward one of the pressure chambers 14 are formed in the vibration plate 330. Each of the recesses 340 is extended in a ring-shape along the periphery of one of the pressure chambers 14 in a plan view. The recesses 340 are formed by patterning a photoresist, and etching the photoresist as a mask.

There are formed on an upper surface of the piezoelectric actuator 303 the outer grooves 336 which are extended in parallel to each other, along the scanning direction and each of which sandwiches the central portion of one of the pressure chambers 14, and the inner grooves 337 which are extended in parallel to each other, each along one of the outer grooves 336, at areas inside of one of the outer grooves 336. Each of the outer grooves 336 includes a pair of parallel portions 336*a* formed in the upper surface of the piezoelectric actuator 303, at areas overlapping with parallel portions in the longitudinal direction of the periphery of one of the pressure chambers 14 respectively, and a curved portion 336*b* which is curved in the vicinity of an area overlapping with one of the communicating holes 15 and which joins the pair of the parallel portions 336*a*. Each of the inner grooves 337 is in the upper surface of the piexoelectric actuator 303 and includes a pair of parallel portions 337*a* extended along the pair of parallel portions 336*a* respectively, and a curved portion 337*b* which is curved in the vicinity of an area overlapping with one of the communicating holes 15 and which joins the pair of the parallel portions 337*a*. The pair of the parallel portions 336*a* of the outer groove 336 and the pair of the parallel portions 337*a* of the inner groove 337 are joined mutually in the vicinity of an area overlapping in a plan view with one of the communicating holes 16. As shown in FIGS. 10 and 11, the outer groove 336 and the inner groove 337 penetrate through the electroconductive layer 335, and have a depth reaching inside of the piezoelectric layer 331. Moreover, a recess 339 (first groove) having a substantially elliptical shape and long in the scanning direction is formed in the upper surface of the piezoelectric actuator 303, at an area (predetermined area) overlapping in a plan view with the central portion of each of the pressure chambers 14, the area being inside of the inner groove 337. A depth of the recess 339 is greater than a combined thickness of the electroconductive layer 335 and the piezoelectric layer 331. Therefore, a portion of the upper surface of the vibration plate 330 is exposed through an opening of the recess 339. Consequently, the depth of the recess 339 in the third embodiment is greater than a depth of the outer groove 336 and a depth of the inner groove 337, similarly as in the first embodiment.

By forming such outer groove 336 and the inner groove 337, each of the individual electrodes 332 is formed to be substantially U-shaped and to have two areas 332*a* extended in the scanning direction, at the area, of the piezoelectric layer 331, overlapping with the peripheral portion of one of the pressure chambers 14 so as to sandwich the area overlapping with the central portion of the pressure chamber 14. Similarly as in the first embodiment, until the outer groove 336 and the inner groove 337 are formed, the individual electrode 32 is also integrated with the electroconductive layer 335, and the outer groove 336 and the inner groove 337 are formed by removing a portion of the electroconductive layer 335 by the laser processing, thereby forming the individual electrode 332 to be isolated (in other words, insulated from the surrounding) from the electroconductive layer 335. Further, by forming the curved portions 336*a* and 337*a* of the outer groove 336 and the inner groove 337, each of the individual electrodes 332 is formed to have a terminal 333 at a position overlapping with one of the pressure chambers 14. Similarly as in the first embodiment, the terminal 333 is connected to a driver IC 345 via a wiring member. A driving signal from the driver IC 345 is supplied selectively to the individual electrodes 332.

Next, an action of the piezoelectric actuator 303 at the time of jetting ink will be explained. The piezoelectric actuator 303 is also driven almost similarly as the piezoelectric actuator 3 of the first embodiment. In other words, when the driving signal (positive electric potential) is selectively applied from the driver IC 345 to a desired individual electrode 332, an electric field in a direction of thickness of the piezoelectric layer 331 is generated in an area of the piezoelectric layer 331 which overlaps with a portion, parallel to the scanning direction of a periphery, of an associated pressure chamber 14, and which is sandwiched between the individual electrode 332 to which the driving signal is supplied and the vibration plate 330 which is kept at the ground electric potential, making the piezoelectric layer 331 contract in a direction parallel to a plane of the piezoelectric layer 331. At this time, as shown in FIG. 11, an area of the piezoelectric actuator 303, overlapping with the portion parallel to the scanning direction of the peripheral portion of the pressure chamber 14 becomes a driving zone B1 (active zone) in which the piezoelectric layer 331 deforms by itself, and another area overlapping with the central portion of the pressure chamber 14 becomes a driven zone B2 (inactive zone) which is deformed along with the deformation of the piezoelectric layer 331 of the driving zone B1. Moreover, an area of the piezoelectric actuator 303, located outside the pressure chamber 14, and at which the vibration plate 330 is joined to the cavity plate 10, becomes a constrained zone B3 in which the deformation of the vibration plate 330 is constrained. Furthermore, while the piezoelectric layer 331 in the driving zone B1 positioned at both sides of the driven zone B2 is contracted in a direction parallel to the plane of the piezoelectric layer 331, the vibration plate 330 in the driving zone B1 is not contracted in the direction parallel to the plane of the piezoelectric layer 331. Therefore, the vibration plate 330 and the piezoelectric layer 331 in the driven zone B2 sandwiched or interposed between the driving zone B1 are deformed, and the vibration plate 330 is deformed to project toward a side opposite to the pressure chamber 14, with a center of the driven zone B2 as an apex (unimorph deformation). Then, as the vibration plate 330 is deformed, the volume in the pressure chamber 14 is increased, and a negative pressure wave is generated in the pressure chamber 14. Further, when the supply of the driving signal from the driver IC 345 to the individual electrode 332 is stopped at a timing similar as in the first embodiment, the electric potential of the individual electrode 332 becomes the ground electric potential, and the vibration plate 330 restores its original shape, thereby decreasing the volume in the pressure chamber 14. At this time, a pressure wave reversed from the negative pressure wave due to the increase in the volume of the pressure chamber 14 and a positive pressure wave generated due to restoration of the shape of the vibration plate 330 are combined. Therefore, a substantial pressure is applied to the ink in the pressure chamber 14. Thus, the ink is jetted from the nozzle 20 corresponding to the pressure chamber 14, and a predetermined printing is performed on a paper.

As described above, according to the ink-jet head 301 in the third embodiment, it is thus possible to have the same effect as in the first embodiment in terms of similar components. Moreover, since the recess 340 is formed to be ring-shaped along the periphery of each of the pressure chambers 14, stiffness of an area, of the vibration plate 330, facing the periphery of each of the pressure chambers 14 is decreased. Therefore, it is possible to substantially deform the areas of the piezoelectric actuator 303, overlapping with the pressure chambers 14 respectively. Moreover, the deformation of the area, of the piezoelectric actuator 303, overlapping with a pressure chamber 14, is suppressed from propagating to another area corresponding to another pressure chamber 14 adjacent to the pressure chamber 14. Therefore, it is possible to further reduce the cross-talk. Moreover, since each of the individual electrode 332 has two areas 332*a*, the piezoelectric layer 331 and the vibration plate 330 are substantially deformed in the areas of the piezoelectric actuator 303, each overlapping with a peripheral portion, of one of the pressure chambers 14 in the scanning direction.

The exemplary embodiments of the present invention have been described above. However, the present invention is not limited to these embodiments, and it is possible to make various modifications to the embodiments within the scope defined by the claims.

First Modification

Figure 12:
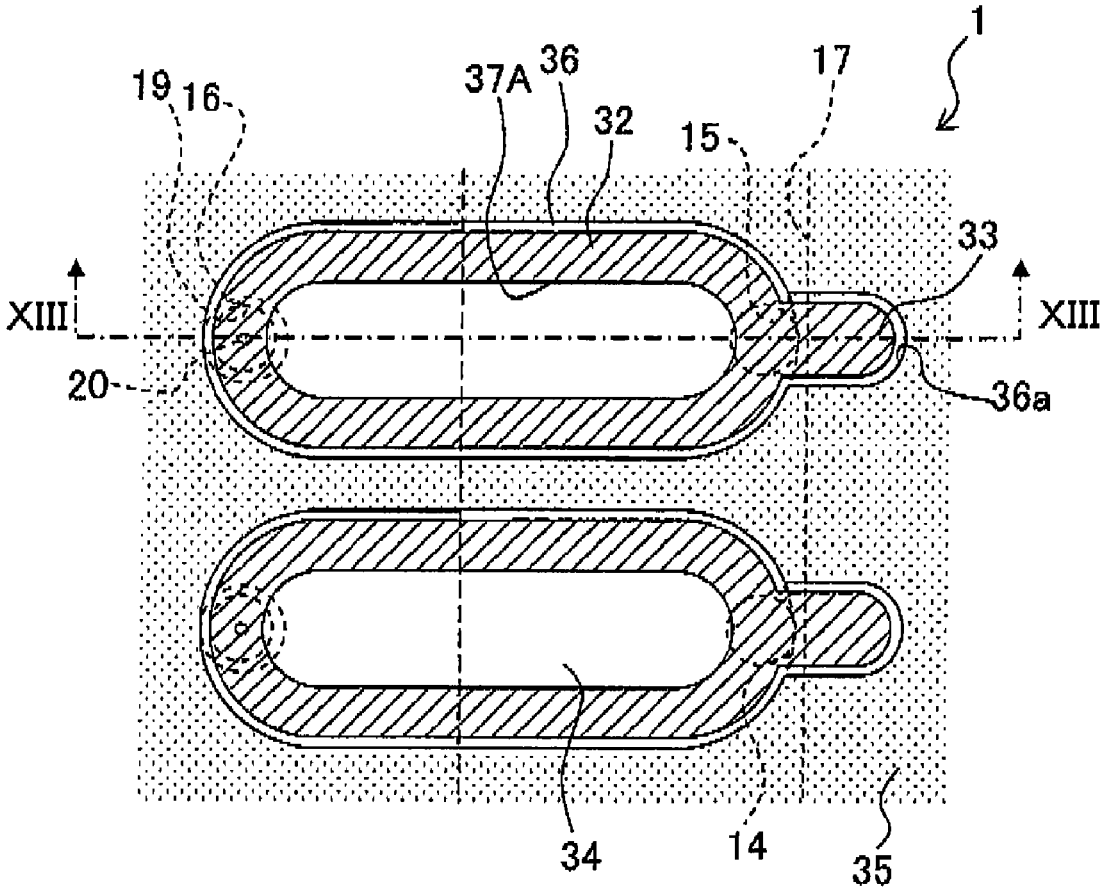
FIG. 12 is a diagram in a first modification of the present invention, corresponding to FIG. 3.
Figure 13:
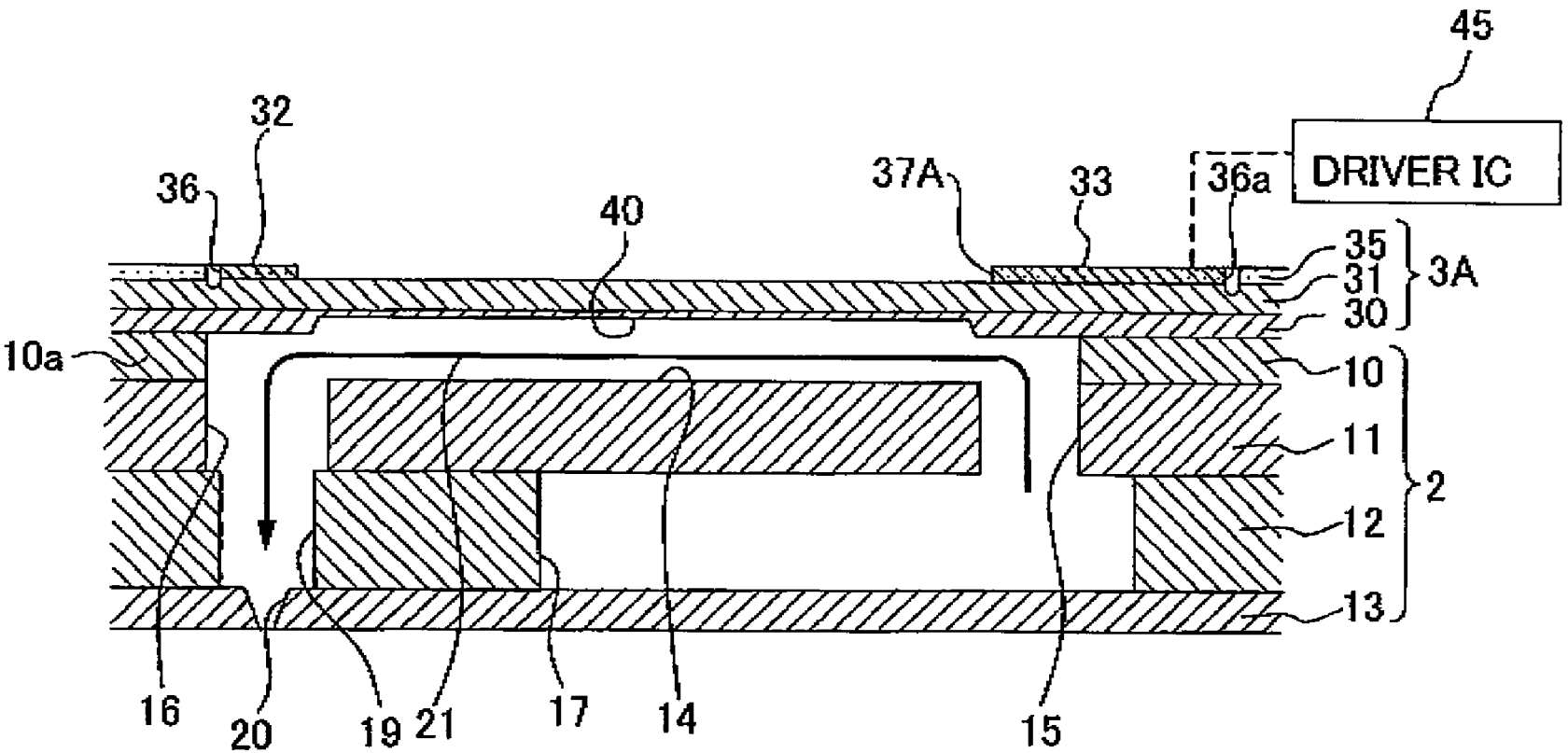
FIG. 13 is a cross-sectional view taken along a line XIII-XIII shown in FIG. 12.

As shown in FIGS. 12 and 13, a recess 37A may be formed in a piezoelectric actuator 3A at a portion inside of each of the outer grooves 36. The piezoelectric actuator 3A of the first modification has a structure similar to the structure of the piezoelectric actuator 3 in the first embodiment, except that the recess 37A is formed in place of the recess 39 and the inner groove 37. As shown in FIG. 13, a depth of the recess 37A is same as a thickness of the electroconductive layer 35. In other words, there is no electroconductive layer 35 in the piezoelectric actuator 3A at areas thereof in each of which the recess 37A is formed, and the piezoelectric layer 31 is exposed through a lower surface of the recess 37A. In this case, since the recess 37A is not formed in the piezoelectric layer 31, the thickness, of the piezoelectric layer 31, in an area overlapping with the recess 37A is same as a thickness in the area overlapping with the individual electrode 32. Thus, even in a case in which the thickness of the electroconductive layer 35 and the depth of the recess 37A are same, when the recess 37A is formed at an area inside of the outer groove 36, it is possible to make the area, of the piezoelectric actuator 3A, in which the recess 37A is formed to be a driven zone, and also to reduce the stiffness of the area, of the piezoelectric actuator 3A, in which the recess 37A is formed.

Second Modification

Figure 14:
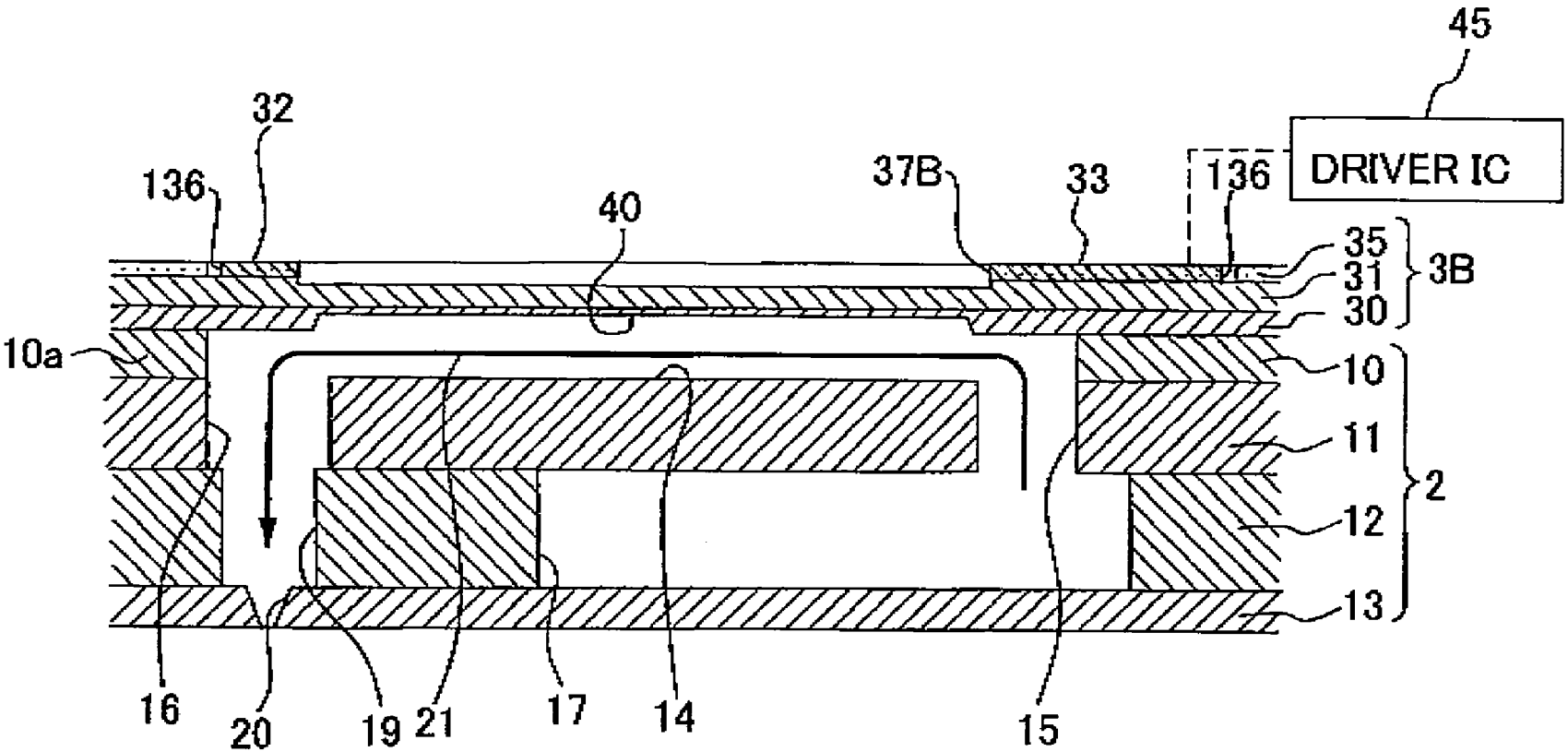
FIG. 14 is a diagram in a second modification of the present invention, corresponding to FIG. 13.

As shown in FIG. 14, a piezoelectric actuator 3B in a second modification has a structure similar to the structure of the piezoelectric actuator 3A in the first modified embodiment, except for a depth of a recess 378 and a depth of an outer groove 136. In the piezoelectric actuator 33, the depth of the outer groove 136 is same as the thickness of the electroconductive layer 35, and the depth of the recess 37B, formed inside of the outer groove 136, is greater than the thickness of the electroconductive layer 35, and less than the combined thickness of the electroconductive layer 35 and the piezoelectric layer 31. In other words, in the second modification, no electroconductive layer 35 is formed in an area of the piezoelectric actuator 3B, in which the recess 37B is formed, and the driven zone is formed in this area. Moreover, since the thickness of the piezoelectric layer 31 in the driven zone is decreased due to the formation of the recess 37B, it is possible to reduce the stiffness of the driven zone of the piezoelectric actuator 33. Here, since the depth of the outer groove 136 is same as the thickness of the electroconductive layer 35, there is no electroconductive layer 35, at the area of the piezoelectric actuator 3B, in which the outer groove 136 is formed. Therefore, it is possible to assuredly insulate the individual electrodes 33 and the electroconductive layer 35 which is adjacent to the individual electrodes 33, with the outer groove 136 being sandwiched between each of the individual electrodes 33 and the electroconductive layer 35.

Third Modification

Figure 15:
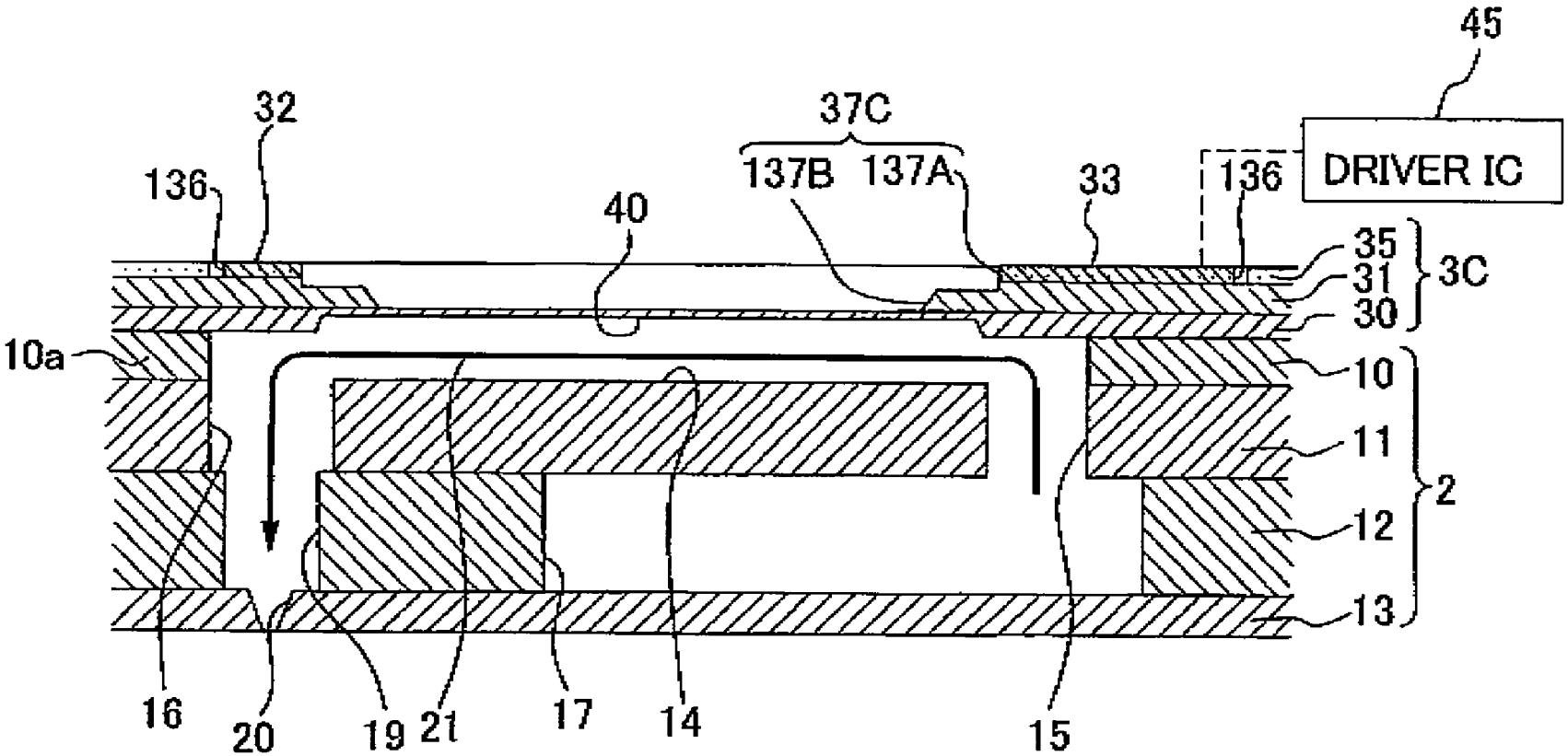
FIG. 15 is a diagram in a third modification of the present invention, corresponding to FIG. 13.

As shown in FIG. 15, a piezoelectric actuator 3C in a third modification includes a recess 37C which is formed of two recesses having mutually different depths (a first recess 137A and a second recess 137B), in place of the recess 37B in the second modification. The first recess 137A is formed in the piezoelectric actuator 3B at an area, which is located inside the outer groove 136, and located outside of the second recess 137B (with respect to the center of the pressure chamber). The depth of the first recess 137A is greater than the thickness of the electroconductive layer 35, and is smaller than the combined thickness of the electroconductive layer 35 and the piezoelectric layer 31. On the other hand, the depth of the second recess 137B is same as the combined thickness of the electroconductive layer 35 and the piezoelectric layer 31. In other words, the piezoelectric layer 31 is exposed through the lower surface of the first recess 137A, whereas the vibration plate 30 is exposed through the lower surface of the second recess 137B. Thus, by forming a deep recess (second recess) in the driven zone inside the outer groove 136, it is possible to reduce the stiffness of the piezoelectric actuator 3C in the driven zone. Moreover, since the vibration plate 30 is not exposed through the first recess 137A, the individual electrode 32 and the vibration plate 30 as the common electrode which is kept at the ground electric potential are separated from each other by a sufficient distance, and there is no fear of these electrodes coming into conduction electrically.

Fourth Modification

Figure 16:
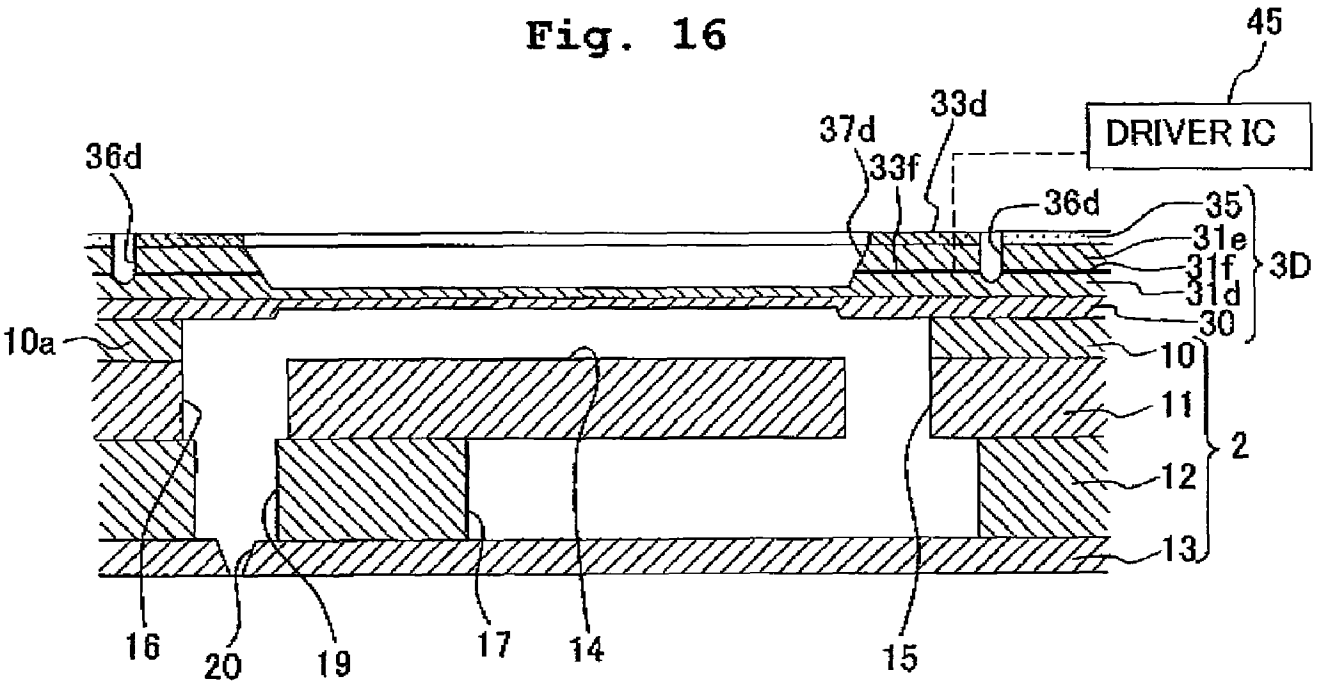
FIG. 16 is a diagram in a fourth modification of the present invention, corresponding to FIG. 13.

As shown in FIG. 16, the piezoelectric layer may include a plurality of layers. A piezoelectric actuator 3D shown in FIG. 16 includes two piezoelectric layers 31*d* and 31*e*, and an electroconductive layer 31*f* formed between the piezoelectric layers 31*d* and 31*e*, and the electroconductive layer 35 is formed on the upper surface of the piezoelectric layer 31*e*. In the piezoelectric actuator 3D, there is formed an outer groove 36*d* having a shape substantially similar to the outer groove 36 in the first embodiment in a plan view, and the outer groove 36*d* has a depth reaching up to the piezoelectric layer 31*d* which is the second layer from the top. Moreover, a recess 37*d* having a depth reaching up to the piezoelectric layer 31*d* is formed in the piezoelectric actuator 3D at an area thereof, located inside the outer groove 36*d* (area overlapping with each of the pressure chambers 14). By the recess 37*d* and the outer groove 36*d*, electrodes 33*d* and 33*f* are defined. The electrode 33*d* and the vibration plate 30 are connected to the driver IC 45 with a wiring not shown in the diagram, to be kept at the ground electric potential all the time, and to function as a common electrode. The electrode 33*f* is connected to the driver IC 45, and functions as an individual electrode. The present invention is applicable to a piezoelectric actuator having a plurality of piezoelectric layers.

In the embodiments and the modifications described above, each of the individual electrodes is integrated with the electroconductive layer until the outer groove and the inner groove are formed; and by forming the outer groove and the inner groove by removing the electroconductive layer, the individual electrodes are formed to be separated from the electroconductive layer, and to be insulated from the surrounding area. However, it is not necessarily indispensable that the individual electrodes are formed in such a manner, and it is also allowable that, after forming individual electrodes insulated from the surrounding, with a method such as the screen printing, the outer grooves and the inner grooves may be formed. Alternatively, it is possible to form the outer grooves and the inner grooves at the same time of forming the piezoelectric layer by forming the piezoelectric layer with a method such as the AD method or the CVD method, in a state that areas which are to become the outer grooves and the inner grooves masked.

Moreover, for example, in each of the embodiments described above, the recesses 39, 239, and 339 are formed to penetrate through the piezoelectric layers 31, 231, and 331, respectively. However, instead of allowing the recesses 39, 239, and 339 to penetrate through the piezoelectric layers 31, 231, and 331, the depth of the recesses 39, 239, and 339 may be smaller than the thickness of the piezoelectric layers 31, 231, and 331, respectively. Moreover, it is allowable that each of the recesses 39, 239, and 339 is not extended in the longitudinal direction of the pressure chamber 14 (scanning direction). Furthermore, it is allowable that each of the recesses 39, 239, and 339 is not formed at a position overlapping with the central portion of the pressure chamber 14. In other words, the predetermined area, in which each of the recesses 39, 239, and 339 are formed, may overlap with an area located away from the central portion of the pressure chamber 14. Moreover, it is allowable that each of the recesses 40 and 340 formed in the vibration plates 30, 230, and 330 is not formed in the vibration plates respectively. Further, it is allowable that each of the recesses 40 and 340 is not extended in the longitudinal direction of the pressure chamber 14. In each of the embodiments described above, the outer grooves 36, 236, and 336, and the inner grooves 37, 237, 337 are formed by removing the electroconductive layers 35, 235, and 335 respectively to penetrate therethrough, and further by removing portions of the piezoelectric layers 31, 231, and 331. However, it is allowable that the grooves are formed without removing the piezoelectric layers 31, 231, and 331, but instead by removing only the electroconductive layers 35, 235, and 335 to penetrate therethrough. The ink-jet head 1 described above is a serial type head which is capable of reciprocating. However, the ink-jet head may be of line type in which the head is fixed. Each of the embodiments described above is an example in which the present invention is applied to an ink-jet head which jets ink from the nozzles. However, this invention is also applicable to other liquid jetting head which jets a liquid other than ink by applying pressure to the liquid.

What is claimed is:

1. A liquid jetting head which jets a liquid, comprising:

a channel unit in which a plurality of pressure chambers separated mutually by partition walls, a plurality of nozzles, and a plurality of individual liquid channels each reaching one of the nozzles via one of the pressure chambers are formed; and a piezoelectric actuator which applies a jetting energy to the liquid in the pressure chambers, and which includes a plate which is fixed to the partition walls to define the pressure chambers, and which has an electroconductive surface on a side opposite to the pressure chambers; a piezoelectric layer which is formed on the plate at an area on a surface of the plate on the side opposite to the pressure chambers; an electroconductive layer which is formed on the piezoelectric layer at an area on a surface of the piezoelectric layer on a side opposite to the plate; the area on the surface of the plate and the area on the surface of the piezoelectric layer facing all the pressure chambers; and a plurality of individual electrodes each of which is insulated from the electroconductive layer by a first groove formed in the electroconductive layer, along an outer periphery of each of the pressure chambers, and by a recess formed on a central area of one of the pressure chambers with respect to the first groove, wherein:

a depth of the first groove is not less than a thickness of the electroconductive layer, and a depth of the recess is greater than the thickness of the electroconductive layer.

2. The liquid jetting head according to claim 1, wherein:

the recess includes a second groove which is formed along a direction in which the first groove is extended, and a first recess which is formed in the piezoelectric actuator at a predetermined area, on a central area of each of the pressure chambers with respect to the second groove; and a depth of the second groove is not less than the thickness of the electroconductive layer, and a depth of the first recess is greater than the thickness of the electroconductive layer.

3. The liquid jetting head according to claim 2, wherein the first recess is formed in the piezoelectric layer.

4. The liquid jetting head according to claim 3, wherein a recess is formed in the plate at an area overlapping with the first recess.

5. The liquid jetting head according to claim 2, wherein the pressure chambers are long in one direction; and the first recess is extended in the one direction.

6. The liquid jetting head according to claim 2, wherein the predetermined area faces a central portion of each of the pressure chambers.

7. The liquid jetting head according to claim 2, wherein a second recess which opens toward each of the pressure chambers is formed in a surface of the plate on a side of the pressure chambers.

8. The liquid jetting head according to claim 7, wherein: the pressure chambers are long in one direction; and the second recess is extended in the one direction, in the plate at an area facing a central portion of each of the pressure chambers.

9. The liquid jetting head according to claim 7, wherein the second recess is extended in a ring-shape along a periphery of each of the pressure chambers.

10. The liquid jetting head according to claim 2, wherein the first groove is formed in the piezoelectric layer.

11. The liquid jetting head according to claim 2, wherein the second groove is formed in the piezoelectric layer.

12. The liquid jetting head according to claim 2, wherein each of the first groove and the second groove is extended in a circular shape; and each of the individual electrodes is formed to be doughnut-shaped.

13. The liquid jetting head according to claim 2, wherein the pressure chamber is long in one direction; and the first groove and the second groove are extended in the one direction, and each of the individual electrodes has two areas which sandwich the central portion of one of the pressure chambers, and which are extended in parallel mutually along the one direction.

14. The liquid jetting head which jets a liquid, comprising:

a channel unit in which a plurality of pressure chambers separated mutually by partition walls, a plurality of nozzles, and a plurality of individual liquid channels each reaching up to one of the nozzles via one of the pressure chambers are formed; and a piezoelectric actuator which applies a jetting energy to the liquid in the pressure chambers and which includes a plate which are fixed to the partition walls to define the pressure chambers, and which has an electroconductive surface on a side opposite to the pressure chambers; a piezoelectric layer which is formed on the plate at an area on a surface of the plate on the side opposite to the pressure chambers; an electroconductive layer on the piezoelectric layer at an area on a surface of the piezoelectric layer on a side opposite to the plate; the area on the surface of the plate and the area of the surface of the piezoelectric layer facing all the pressure chambers; and a plurality of individual electrodes each of which is insulated from a surrounding thereof, by a first groove formed along an outer periphery of one of the pressure chambers, and by a recess formed on a central area of one of the pressure chambers with respect to the first groove, wherein:

a depth of the first groove is greater than a thickness of the electroconductive layer, and a depth of the recess is not less than the thickness of the electroconductive layer.

15. A method of producing a liquid jetting head comprising a channel unit in which a plurality of individual liquid channels reaching up to nozzles via pressure chambers respectively is formed, and in which mutually adjacent pressure chambers among the pressure chambers are separated by partition walls; and a piezoelectric actuator which applies a jetting energy to the liquid in the pressure chambers, the method comprising:

a step for providing the channel unit in which the pressure chambers are formed;

a step for providing a substrate;

a plate-forming step for forming a plate which defines the pressure chambers when the substrate is fixed to the partition walls of the channel unit, by forming an electroconductive layer on a surface of the substrate, on a side to be arranged opposite to the pressure chambers;

a piezoelectric-layer forming step for forming a piezoelectric layer, without a gap, in an area on an electroconductive surface of the plate, the area facing all the pressure chambers when the plate is fixed to the channel unit;

an electroconductive-layer forming step for forming an electroconductive layer, without a gap, in an area on a surface of the piezoelectric layer on a side opposite to the plate, the area facing all the pressure chambers when the plate is fixed to the channel unit;

an individual-electrode forming step for forming individual electrodes insulated from the electroconductive layer surrounding the individual electrodes, by removing the electroconductive layer along the outer periphery of each of the pressure chambers to form a first groove having a depth of not less than a thickness of the electroconductive layer, and by removing the electroconductive layer along a direction in which the first groove is extended to form a second groove having a depth of not less than the thickness of the electroconductive layer on a central area of each of the pressure chambers with respect to the first groove; and a first-recess forming step for forming a first recess having a depth of more than the thickness of the electroconductive layer by removing the electroconductive layer and the piezoelectric layer at the central area of each of the pressure chambers with respect to the second groove.

16. The method of producing the liquid jetting head according to claim 15, wherein in the first-recess forming step, the first recess is formed by removing the piezoelectric layer at a portion on a central area of each of the pressure chambers with respect to the second groove.

17. The method of producing the liquid jetting head according to claim 16, wherein in the first-recess forming step, the first recess is formed by removing a part of the plate on the central area of each of the pressure chambers with respect to the second groove.

18. The method of producing the liquid jetting head according to claim 15, wherein in the individual-electrode forming step, the first groove is formed by removing the piezoelectric layer along the outer periphery of each of the pressure chambers.

19. The method of producing the liquid jetting head according to claim 15, wherein in the individual-electrode forming step, the second groove is formed by removing the piezoelectric layer along a direction in which the first groove is extended.

20. The method of producing the liquid jetting head according to claim 15, wherein in the individual-electrode forming step, each of the individual electrodes is formed to have a doughnut-shape by forming the first groove and the second groove each having a circular shape.

21. The method of producing the liquid jetting head according to claim 15, wherein the pressure chambers are long in one direction; and in the individual-electrode forming step, each of the individual electrodes is formed to have two areas mutually extending in parallel along the one direction and sandwiching the central portion of one of the pressure chambers, by forming the first groove and the second grove extended in the one direction.

22. The method of producing the liquid jetting head according to claim 15, wherein in the first-recess forming step and the individual-electrode forming step, one of the electroconductive layer and the piezoelectric layer is removed by irradiating a laser beam.

23. The method of producing the liquid jetting head according to claim 15, further comprising a second-recess forming step for forming by etching a second recess which opens toward the pressure chambers, in the plate at an area facing each of the pressure chambers.

24. The method of producing the liquid jetting head according to claim 23, wherein the pressure chambers are long in one direction; and in the second-recess forming step, the second recess is formed in the plate at an area facing a central portion of each of the pressure chambers to extend along the one direction.

25. The method of producing the liquid jetting head according to claim 23, wherein in the second-recess forming step, the second recess is formed in the plate to extend in a ring-shape, along the outer periphery of each of the pressure chambers.

* * * * *